US007088942B2

(12) United States Patent
Minagawa

(10) Patent No.: US 7,088,942 B2
(45) Date of Patent: Aug. 8, 2006

(54) TONER SUPPLY CONTAINER, TONER SUPPLYING APPARATUS, AND DRIVING FORCE TRANSMITTING MECHANISM

(75) Inventor: Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 389 days.

(21) Appl. No.: 10/278,807

(22) Filed: Oct. 24, 2002

(65) Prior Publication Data

US 2003/0081968 A1 May 1, 2003

(30) Foreign Application Priority Data

Oct. 25, 2001 (JP) ..... 2001/328268

(51) Int. Cl.
*G03G 15/08* (2006.01)

(52) U.S. Cl. ..... 399/258; 399/106; 399/262; 399/263

(58) Field of Classification Search ..... 399/36, 399/103, 105, 106, 167, 262, 263, 258
See application file for complete search history.

(56) References Cited

U.S. PATENT DOCUMENTS 5,166,731 A * 11/1992 Aimoto et al. ..... 399/103
5,170,212 A * 12/1992 DeCecca ..... 399/103
5,655,180 A * 8/1997 Yasuda et al. ..... 399/106
5,828,935 A 10/1998 Tatsumi et al. ..... 399/260
5,890,040 A * 3/1999 Matsuoka et al. ..... 399/262
5,966,574 A * 10/1999 Ui et al. ..... 399/258
6,011,942 A * 1/2000 Taniguchi et al. ..... 399/167
6,169,864 B1 * 1/2001 Baxendell et al. ..... 399/106
6,295,425 B1 * 9/2001 Garcia et al. ..... 399/103
6,385,418 B1 * 5/2002 Fukuchi ..... 399/167
6,587,660 B1 * 7/2003 Ueno et al. ..... 399/263
2004/0013445 A1 * 1/2004 Yamada et al. ..... 399/106

FOREIGN PATENT DOCUMENTS

JP 5-75768 10/1993
JP 10-63076 3/1998
JP 10-63084 3/1998

* cited by examiner

*Primary Examiner*—Susan Lee
(74) *Attorney, Agent, or Firm*—Fitzpatrick, Cella, Harper & Scinto

(57) ABSTRACT

A toner supply container is detachably mountable to an image forming apparatus and includes: a container body for accommodating toner; an opening, formed in the container body, for permitting the supply of the toner into the image forming apparatus; and a driving-force receiving member for receiving a driving-force from a driving-force applying member provided in the main assembly. The driving-force receiving member includes an elastic press-fitting engagement member which is engageable with an elastic press-fitting engagement member provided in the main assembly. A part of one of the elastic press-fitting engagement members which is an elastic member is elastically restorable to establish driving-force transmitting engagement between the two engagement members.

19 Claims, 20 Drawing Sheets

TONER SUPPLY CONTAINER, TONER SUPPLYING APPARATUS, AND DRIVING FORCE TRANSMITTING MECHANISM

FIELD OF THE INVENTION AND RELATED ART

The present invention relates to a refill toner container and a toner-supplying apparatus, which are employed by an electrophotographic image forming apparatus, and in particular, a copying machine, a printer, a facsimile machine, a word processor, etc.

Also, the present invention relates to a driving-force transmission mechanism for transmitting a driving force from a driving-force transmitting member to a driving-force receiving member.

In the field of an electrophotographic image forming apparatus, such as an electrophotographic copying machine, a printer, etc., toner in the form of a microscopic particle has been used as developer. As the toner in the main assembly of an electrophotographic image forming apparatus is consumed, refill toner is supplied to the image-forming-apparatus main assembly with the use of a toner supply container (refill toner container).

Since toner is in the form of a microscopic particle, it is likely to scatter while supplying the image-forming-apparatus main assembly with toner. According to one of the known methods for preventing this scattering of toner, a refill toner container is placed in the main assembly of an image forming apparatus, and the refill toner within the container is discharged little by little from a small opening of the container.

Refill toner containers such as the above-described one are all structured so that as the toner conveying member of the container, or the main structure of the container, is driven by the driving force transmitted from the image-forming-apparatus main assembly, the refill toner is discharged from the container. There are several methods for transmitting a driving force from the apparatus main assembly to the refill toner container. For example, according to the method disclosed in Japanese Laid-open U.M. Application 5-75768, the refill-toner bottle itself, that is, the main structure of the bottle, is provided with a gear portion, which is on the peripheral surface of the bottle. This gear portion meshes with a driver gear connected to a mechanical power source. Thus, as the driver gear is rotated by the mechanical power source, the toner bottle is rotationally driven.

According to the method disclosed in Japanese Laid-open Patent Application 10-63084, the end surface of the toner bottle is provided with a projection for rotationally driving the refill-toner bottle. This projection is fitted into the recess of the driving portion of the image-forming-apparatus main assembly to transmit the driving force from the main assembly.

Also, according to the method disclosed in Japanese Laid-open Patent Application 10-63076, the internal surface of the rotational force transmitting portion of the image-forming-apparatus main assembly is provided with a plurality of grooves, and the toner container is provided with a projection which fits in the grooves on the main assembly. Thus, a rotational driving force is transmitted by fitting the projection of the container into one of the grooves of the main assembly.

As described above, there have been proposed various methods for transmitting a driving force to drive the refill toner container.

However, the driving-force transmitting methods such as those described above have several technical problems.

In the case of the method described in Japanese Laid-open U.M. Application 5-75768, when a user mounts the toner bottle into the image-forming-apparatus main assembly, the gear portion on the peripheral surface of the toner bottle must be properly meshed with the driving gear portion of the main assembly. Therefore, the user is required to be extremely careful when inserting the toner bottle. In other words, the operation for refilling the main assembly with toner substantially taxes the user. Further, since the toner bottle is rotated through the meshing of one gear to the other, the bottle is subjected to a moment which acts in a direction a perpendicular to the axis of the bottle. Therefore, there is a possibility that the toner bottle is displaced upward or sideways, failing to normally rotate. In order to prevent this type of toner-bottle displacement, the toner bottle must be fully encased. However, such encasement makes it impossible for the toner bottle to be easily mounted or dismounted. In addition, it complicates the toner-supply system itself, resulting in a cost increase.

In the case of the methods described in Japanese Laid-open Patent Application Nos. 10-63084 and 10-63076, when inserting the toner bottle, the projection on the end surface of the toner bottle must be fitted into the recess of the driving portion on the main-assembly side, or the projection on the main-assembly side must be fitted into the recess in the end surface of the toner bottle. Therefore, the toner bottle must be properly positioned in terms of its circumferential direction so that the projection properly fits into the recess. Requiring a user to carry out such a delicate procedure reduces the efficiency with which the bottle is inserted into the main assembly. Further, it may result in a situation that the driving force cannot be properly transmitted due to a slight misalignment.

As for the means for preventing the above-described engagement failure between the toner bottle and the driving portion of the main assembly, it is possible to provide the peripheral surface of the toner bottle with guide ribs in order to properly position the toner bottle in terms of the circumferential direction when inserting the bottle, or to control the rotation of the driving portion of the main assembly so that the recess of the driving portion of the main assembly always assumes a predetermined position as the driving portion comes to stop. In either case, the toner-supplying system becomes complicated in structure, resulting in cost increase.

In most of the above-described driving force transmitting mechanisms based on the coupling between male- and female-type portions, the driving portion of the main assembly is spring-loaded so that if the rotational phase of the toner bottle is not in synchronized with that of the driving portion of the main assembly when the toner bottle is inserted into the main assembly, the driving portion of the main assembly temporarily retracts, and then, comes back to the engagement position as the two sides synchronize in rotational phase. In this type of structure, if the rotational phase of the toner bottle is not synchronized with that of the driving portion of the main assembly when the toner bottle is inserted into the main assembly, the driving portion of the main assembly temporarily retracts, and as the bottle is rotated, the two sides becomes synchronized in rotational phase, allowing the driving portion of the main assembly to return to its normal position to engage with the toner bottle. This, however, makes the driving portion of the main assembly complicated. Further, the retraction of the driving portion of the main assembly requires an additional space, being therefore undesirable in consideration of the fact that the main assembly is desired to be reduced in size.

SUMMARY OF THE INVENTION

The primary object of the present invention is to provide a refill toner container that is simple in the structure of the driving-force receiving portion which is engaged with the driving-force transmitting portion of an image forming apparatus.

Another object of the present invention is to provide a toner-supplying apparatus that is simple in the structure of the driving-force transmitting portion which is engaged with the driving-force receiving portion of a refill toner container.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the driving-force transmitting mechanism, the refill toner container, sealing member, and the toner-supplying apparatus in accordance with the present invention will be described in detail with reference to the appended drawings.

Embodiment 1

Figure 1:
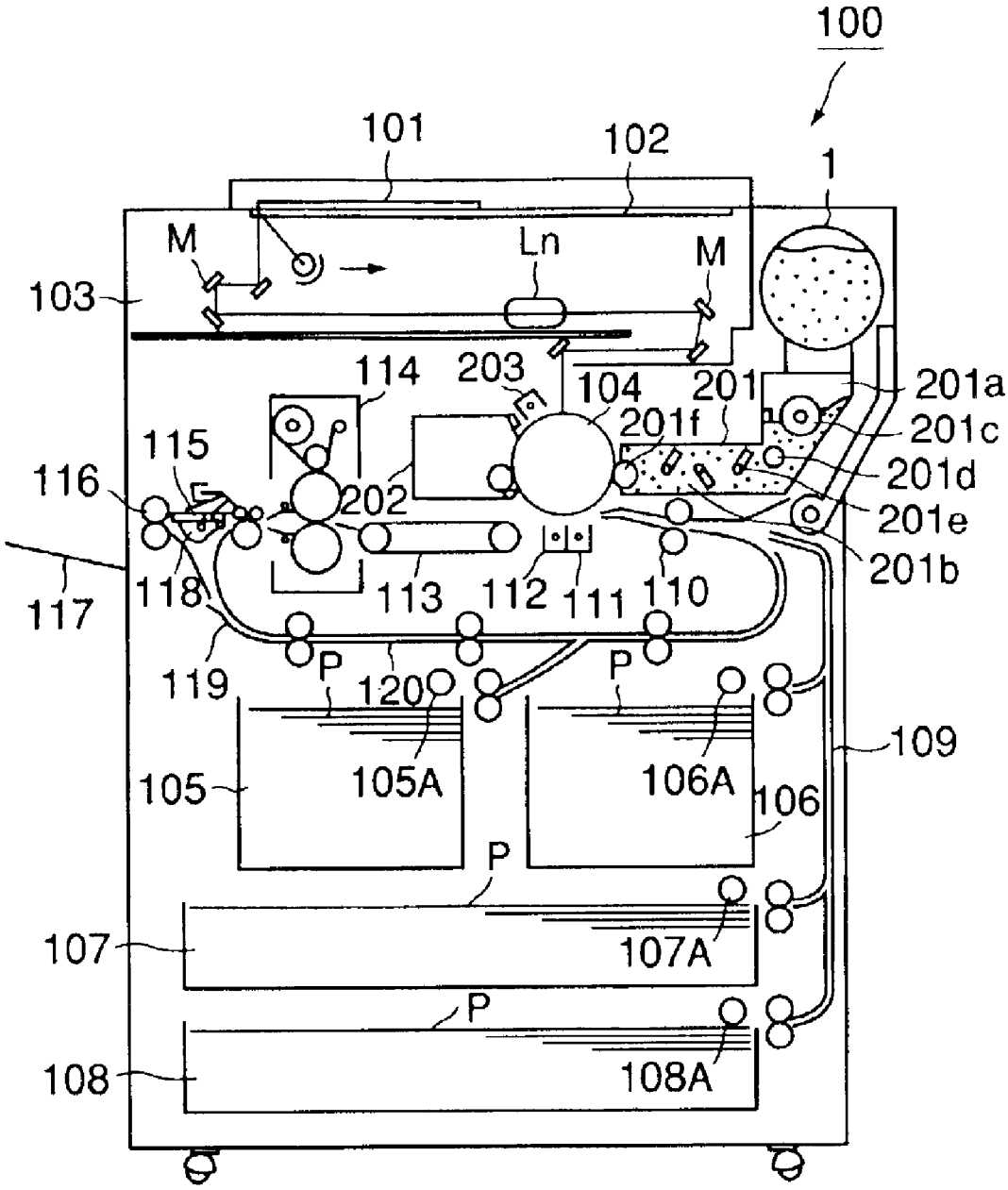
FIG. 1 is a sectional view of the first embodiment of the image forming apparatus in accordance with the present invention.

First, referring to FIG. 1, the structure of an example of an electrophotographic image forming apparatus, that is, an image forming apparatus which forms images using an electrophotographic image-forming method, in which a refill toner container in accordance with the present invention, is mounted will be described.

[Electrophotographic Image Forming Apparatus]

As an original 101 is placed on the original-placement glass 102 in the main assembly (which hereinafter will be referred to as the "apparatus main assembly") of the electrophotographic image forming apparatus in FIG. 1, an optical image in accordance with the image-formation information of the original 101 is formed on the electrophotographic photoconductive drum (which hereinafter will be referred to as the "photoconductive drum") 104, as an image bearing member, by the combination of a plurality of mirrors M and a lens Ln. An optimal recording medium P (which hereinafter will be referred to as "recording paper") is selected among a plurality of recording media stored in cassettes 105, 106, 107, and 108, one for one, based on the information which a user inputs from the control panel 100*a* shown in FIG. 2, or the paper size of the original; in other words, the cassette containing the optimal recording medium P is selected among the cassettes 105, 106, 107, and 108 based on the information regarding the size of the media therein. The type of recording medium does not need to be limited to recording paper. For example, an OHP sheet, etc., may be selected as necessary.

The recording papers in the selected cassette are conveyed one by one by the feeding/separating apparatuses 105A, 106A, 107A, and 108A to the registration roller 110 through the conveyer portion 109. The registration roller 110 allows each recording paper P to be conveyed to the transfer station in synchronism with the rotation of the photoconductive drum 104 and the scanning timing of an optical portion 103. In the transfer station, a toner image formed on the photoconductive drum 104 is transferred onto the recording paper P by the transfer discharger 111. Then, the recording paper P with the toner image is separated from the photoconductive drum 104 by the separation discharger 112.

Thereafter, the recording paper P is conveyed to the fixing station 114 by the conveyer portion 113. In the fixing station 114, the unfixed toner image on the recording paper P is fixed to the recording paper P by heat and pressure. Then, when the image forming apparatus is in the one-sided recording mode, the recording paper P is conveyed through the paper reversing portion 115, and is discharged into the delivery tray 117 by the discharge rollers 116, whereas when the apparatus is in the two-sided recording mode, the recording paper p is directed to the re-feeding conveyance path 119 by the flapper 118 of the paper reversing portion 115, and is conveyed to the registration roller 110 through the re-feeding conveyance paths 119 and 120. Then, the recording paper P is conveyed through the path through which a recording paper is conveyed when the image forming apparatus is in the one-sided recording mode. Then, it is discharged into the delivery tray 117.

Further, when the image forming apparatus is in the multilayer mode, the recording paper P is partially discharged by the discharge rollers 116 through the paper reversing portion 115. More specifically, the recording paper P is partially moved out of the main assembly until the trailing end of the recording paper P passes the flapper 118. Then, while the recording paper P is still held sandwiched by the discharger rollers 116, the flapper 118 is changed in position and the discharger rollers 116 are rotated in reverse. As a result, the recording paper P is conveyed back into the apparatus main assembly 100. Thereafter, the recording paper P is conveyed to the registration roller 110 through the re-feeding paths 119 and 120. Then, it is discharged into the delivery tray 117 after being conveyed through the path through which a recording paper is conveyed when the image forming apparatus is in the one-sided recording mode.

In the apparatus main assembly 100 structured as described above, the developing apparatus 201 as a developing means, a cleaning apparatus 202, a primary charger 203, etc., are disposed around the photoconductive drum 104.

The developing apparatus 201 is for developing an electrostatic latent image formed on the photoconductive drum 104 by the optical portion 103 based on the image-formation information of the original 101. In order to supply refill toner to the developing apparatus 210, the image forming apparatus employs a refill toner container 1, which is removably mountable in the apparatus main assembly by a user.

The developing apparatus 201 is provided with a toner hopper 201*a* as a toner receiving vessel, and a developing device 201*b*. The toner hopper 201*a* is provided with a stirring member 201*c* for stirring the toner supplied from refill toner container 1. After being stirred by the stirring member 201*c*, the toner is sent by the magnetic roller 201*d* to the developing device 201*b*, which has a development roller 201*f* and a plurality of toner sending members 201*e*. After being sent by the magnetic roller 201*f* to the developing device 201*b*, the toner is sent by the toner sending members 201*e* to the development roller 201*f*, by which it is supplied to the photoconductive drum 104.

The cleaning apparatus 202 is for removing the toner remaining on the photoconductive drum 104. The primary charger 203 is for charging the photoconductive drum 104.

Figure 2:
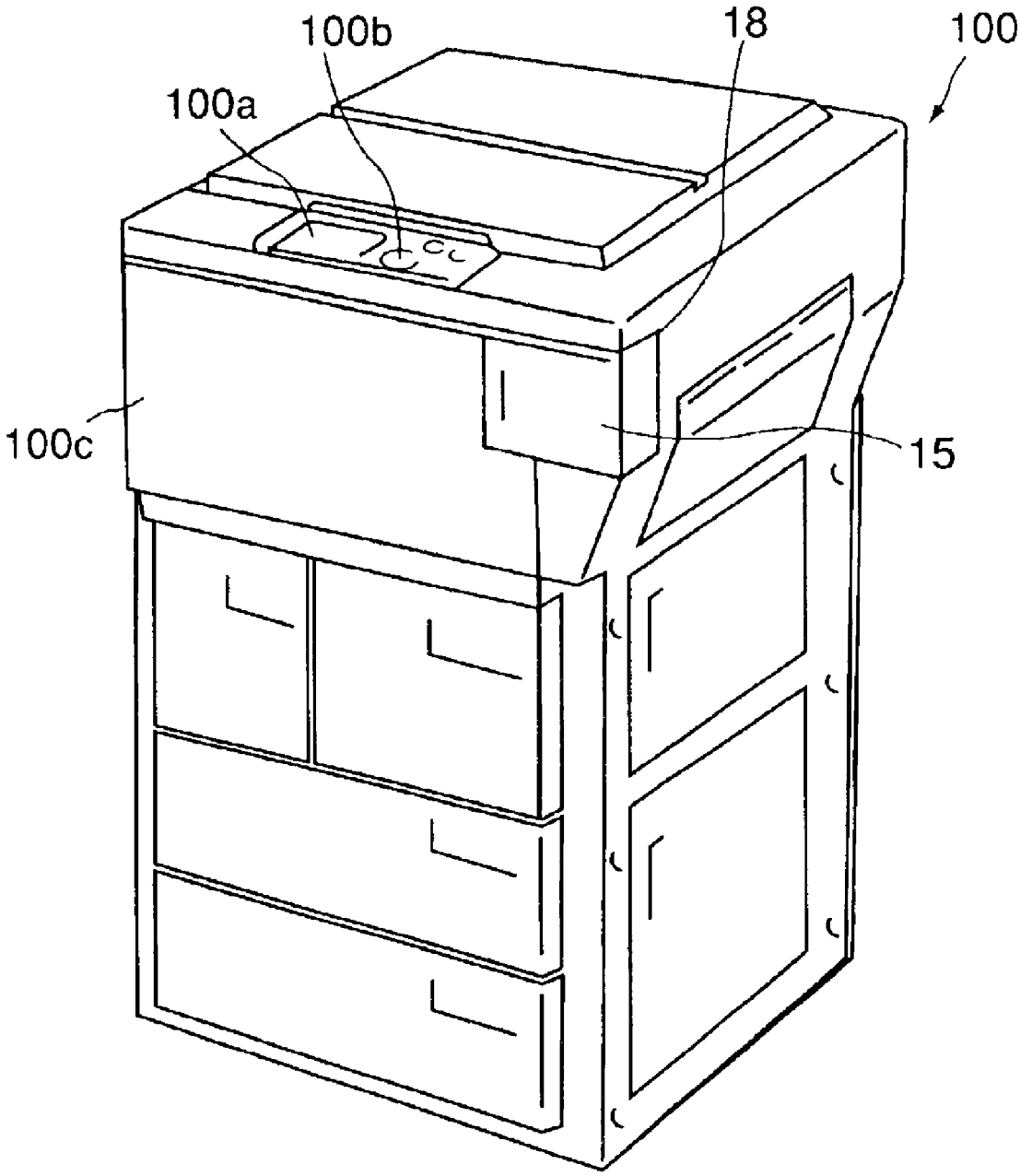
FIG. 2 is a perspective view of the image forming apparatus in FIG. 1.
Figure 3:
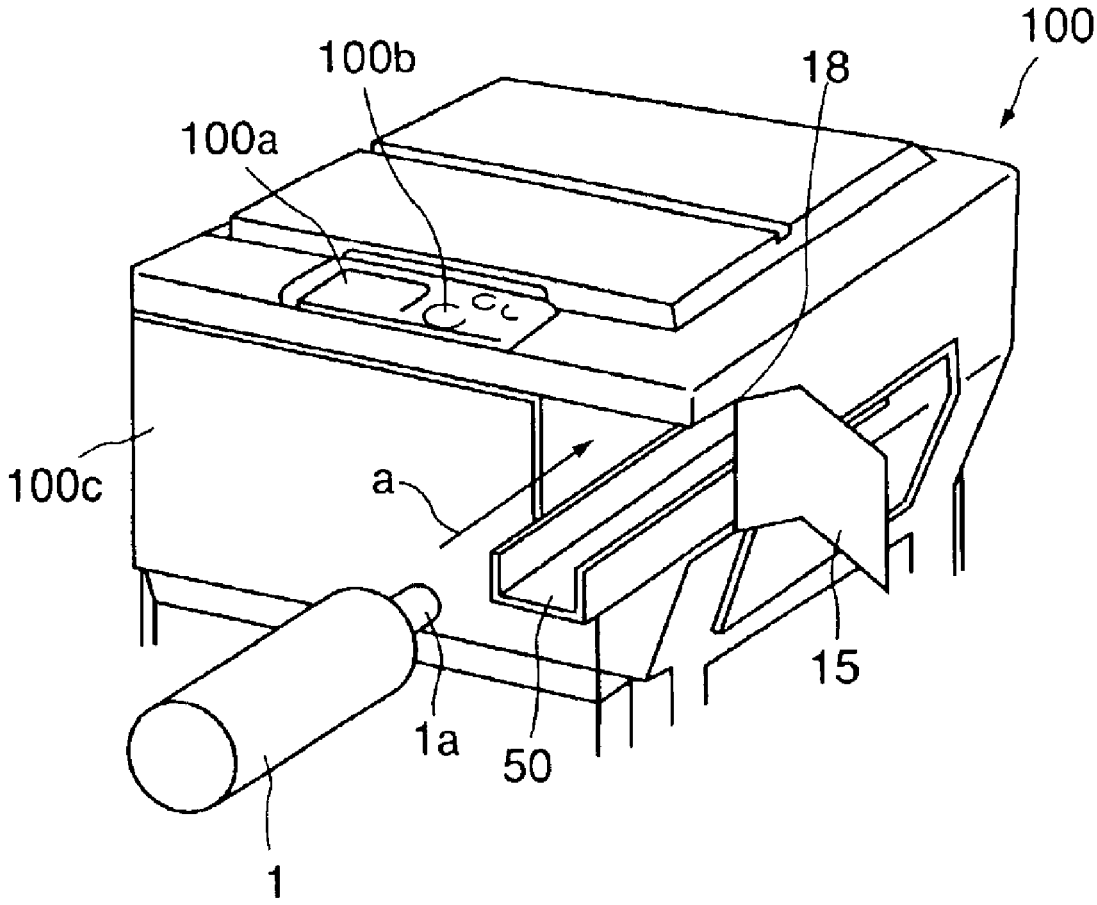
FIG. 3 is a perspective drawing for showing how a refill toner container is mounted into the image forming apparatus.
Figure 4:
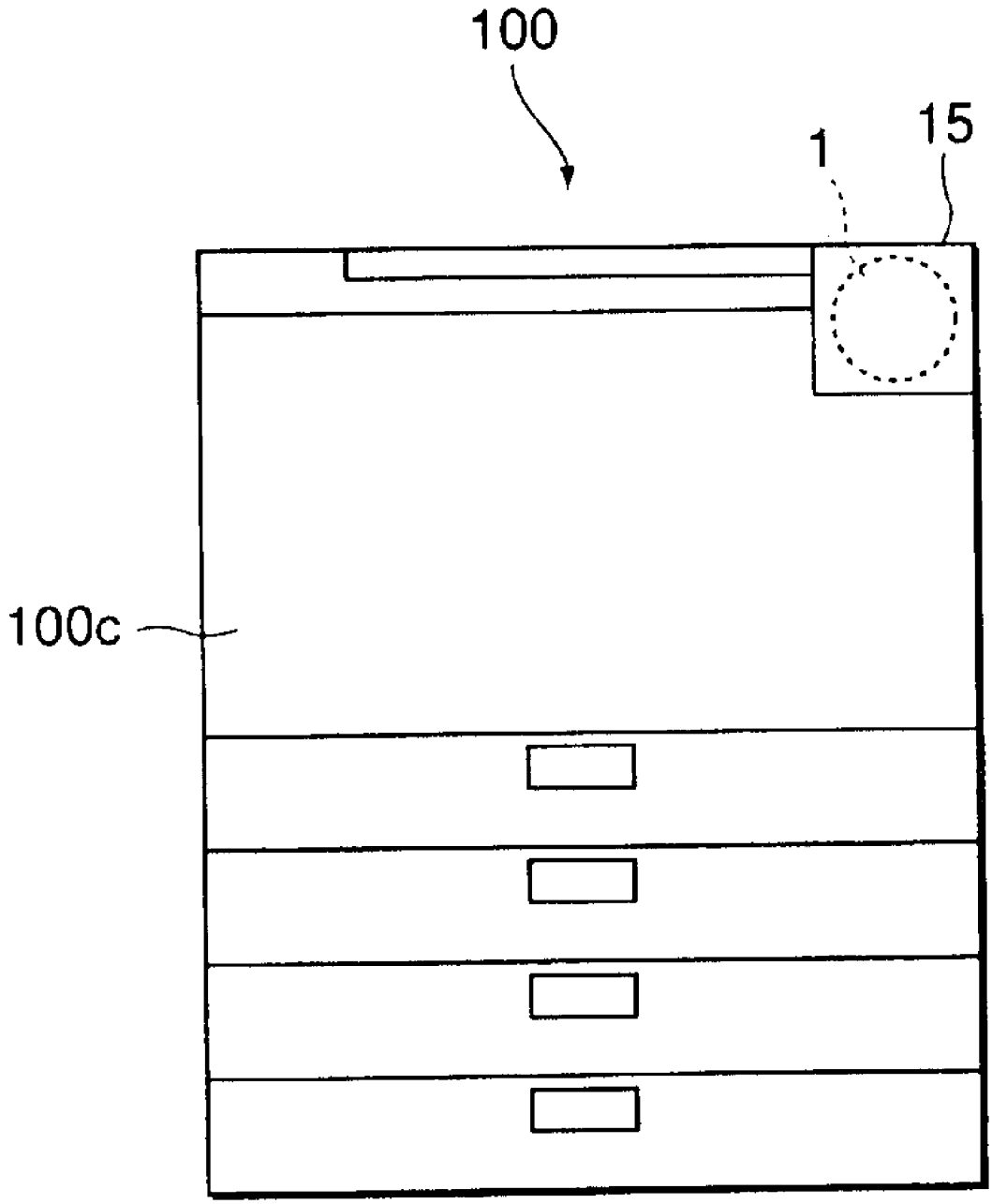
FIG. 4 is a front view of the image forming apparatus in FIG. 1.
Figure 5:
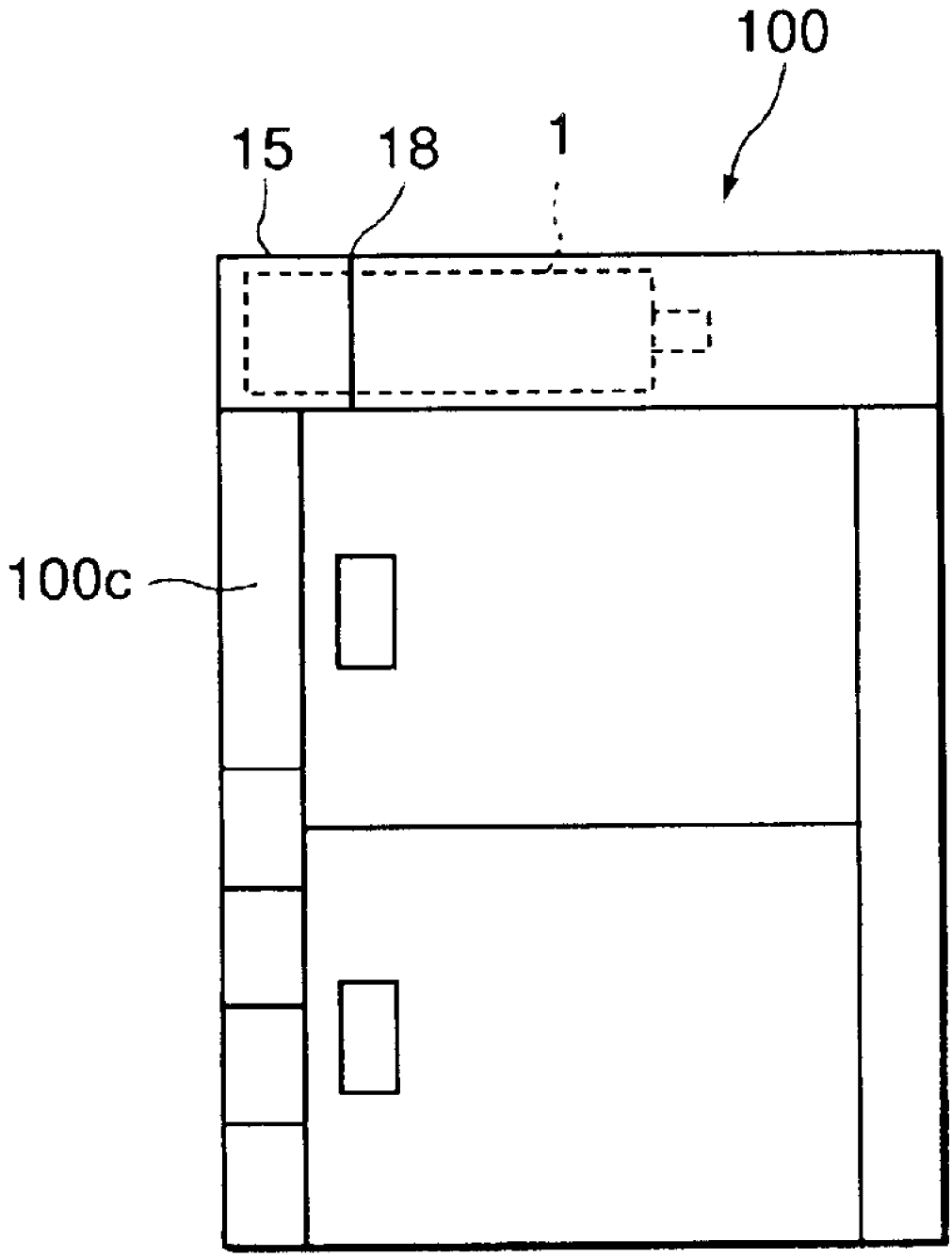
FIG. 5 is a side view of the image forming apparatus in FIG. 1.

Referring to FIG. 3, as a user opens the refill-container replacement cover 15, that is, one of the front covers of the apparatus main assembly, for replacing the refill toner container 1 (which hereinafter will be referred to as the "refill-container replacement cover") shown in FIG. 2, the container bed 50, (also called the refill-toner-bottle bed), which constitutes a part of the toner receiving apparatus, is pulled out to a predetermined position, by a driving mechanism (unshown). The refill toner container 1 is to be placed on this container bed 50. On the other hand, when a user wants to take the refill toner container 1 out of the apparatus main assembly 100, the user is to open the refill-container replacement cover 15 to pull the container bed 50 out of the apparatus main assembly 100, and remove the refill toner container 1 from the bed 50. The refill-container replacement cover 15 is a cover dedicated for mounting or removing (replacing) the refill toner container 1; it is opened or closed only for mounting or removing the refill toner container 1. Incidentally, the apparatus main assembly 100 is maintained by opening the front cover 100*c*.

The provision of the container bed 50 is not mandatory. In other words, the refill toner container 1 may be directly mounted in the apparatus main assembly 100 or removed therefrom.

[Toner Supplying Process]

Figure 7:
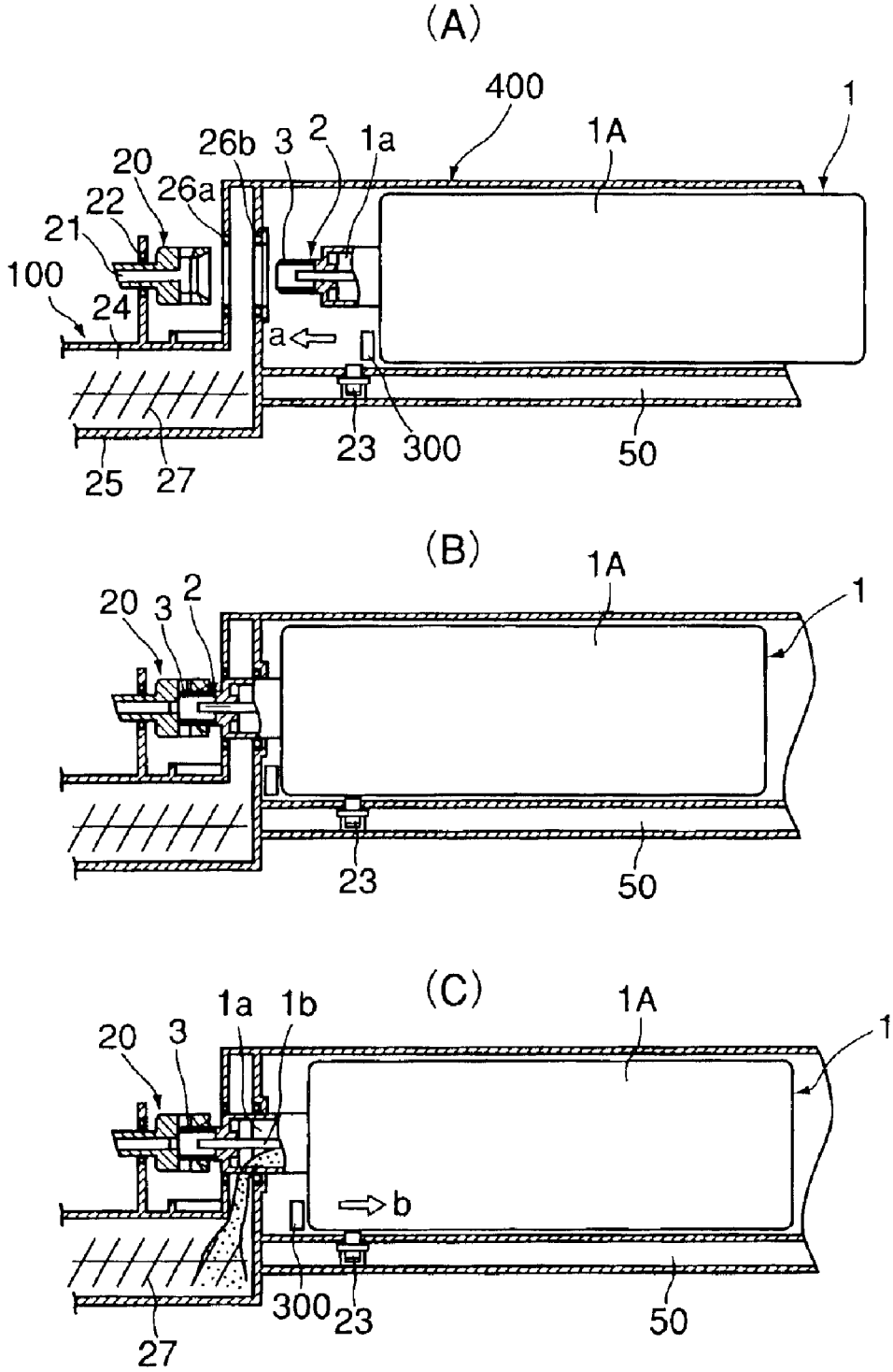
FIGS. 7(A), 7(B), and 7(C) are sectional views of the refill toner container and the components in its adjacencies thereof, for showing the mounting process, (A), (B), and (C) being the initial, mid, and final stages thereof, respectively.

First, referring to FIGS. 7(A), 7(B), and 7(C), the process for supplying the developing apparatus with toner, using the refill toner container 1 (which hereinafter will be referred to "toner bottle") in this embodiment, will be described. FIGS. 7(A), 7(B), and 7(C) correspond to various stages, one for one, in the process in which the refill toner is supplied to the developing apparatus by inserting the toner bottle 1 in this embodiment into the apparatus main assembly 100.

As shown in the drawings, the apparatus main assembly 100 is provided with a toner-supplying apparatus 400, and the tone-supplying apparatus 400 is provided with a driving portion (driving-force transmitting member) 20, which is to be connected to the toner bottle 1 to rotationally drive the toner bottle 1. The driving portion 20 is rotationally supported by a bearing 22, and is rotationally driven by an unshown motor disposed in the apparatus main assembly 100.

The apparatus main assembly 100 is also provided with a partitioning wall 25 for forming a toner supply path 24 connected to the hopper 201*a*. The partitioning wall 25 is provided with internal and external seals 26*a* and 26*b*, which are solidly fixed to the partitioning wall 25 in order to rotationally support the toner bottle 1 by a part of the toner bottle 1, as well as sealing the toner supply path 24. The toner supply path 24 is provided with a screw 27, which is disposed in the supply path 24 in order to convey the refill toner to the hopper 201*a*.

FIG. 7(A) shows the combination of the driving portion 20 and toner bottle 1 in the initial stage of the process in which the toner bottle 1 is mounted into the apparatus main assembly 100. The toner bottle 1 is provided with a refill toner outlet 1*a* (which hereinafter will be simply referred to as the "toner outlet"), which is attached to the one of the end walls of the toner bottle 1. The toner outlet 1*a* in this embodiment is cylindrical, and its axial line approximately coincides with the rotational axis of the toner bottle 1. The opening at the end of the toner outlet 1*a* is sealed with the sealing member 2.

FIG. 7(B) shows the state of the combination of the driving portion 20 and toner bottle 1 after the completion of the engagement between the driving-force receiving portion 3 located at the end of the sealing member 2 and the driving portion 20 on the apparatus-main-assembly side, that is, the state in which the toner bottle 1 is ready to be driven. The engagement between the driving portion 20 on the apparatus-main-assembly side and the sealing member 20 is accomplished by the force applied by a user as the user inserts the toner bottle 1. In this state, the driving-force receiving portion 3 of the sealing member 2 as the driving-force receiving member is in connection with the driving portion 20 on the apparatus-main-assembly side, being therefore, fixed in position in terms of its thrust direction (direction in which refill toner container is mounted). Therefore, unless this engagement between the driving-force receiving portion 3 and the driving portion 20 is dissolved, the sealing member 2 remains fixed in position by the driving portion 20, and hence, by the image forming apparatus.

FIG. 7(C) shows the state of the combination of the driving portion 20 and toner bottle 1 at the end of the final stage of the toner bottle mounting process. In the final stage of the toner bottle mounting process, that is, the stage after the engagement between the sealing member 2 and driving portion 20, a sliding member 300 is moved in the direction indicated by an arrow mark b by the closing movement of the refill-container replacement cover 15, forcing the sealing member 2 to move, relative to a drive shaft 1*b*, sliding on the driving shaft 1*b*. As a result, the sealing member 2 is separated from the toner bottle 1, exposing the opening of the toner outlet 1*a*, in other words, readying the toner bottle 1 for refill toner delivery. Also in this stage, the driving shaft 1*b* fixed to the main structure (which hereinafter will be referred to as the "bottle main structure") of the toner bottle 1 is not completely disengaged from the sealing member 2; a part of the drive shaft 1*b* remains in the sealing member 2. The cross section of the hole of the sealing member 2 through which the drive shaft 1*b* is slidably put, and the cross section of the drive shaft 1*b* itself, are in the noncircular form, for example, a square, a triangle, etc., which makes it possible for the driving force to be transmitted.

As the unshown motor is activated in the state shown in FIG. 7(C), the rotational driving force is transmitted from the driving portion 20 of the apparatus main assembly to the sealing member 2, and then, is transmitted from the sealing member 2 to the bottle driving shaft 1*b*. As a result, the bottle 1 is rotated. In other words, this sealing member 2 performs two functions: not only does it seal the toner bottle 1*b*, but also transmits the rotational driving force to the toner bottle 1.

The toner bottle 1 is rotationally supported by the bottle supporting rollers 23 of the refill-toner-bottle bed 50. Therefore, even when the torque applied to the toner bottle 1 is small, the bottle 1 smoothly rotates. There are four bottle supporting rollers 23 different in location so that the bottle main structure is supported by four different points thereof. The bottle supporting rollers 23 are rotationally supported by the toner-supplying apparatus of the apparatus main assembly 100. As the toner bottle 1 rotates, the refill toner in the toner bottle 1 is gradually discharged from the opening of the toner outlet 1*a*, into the toner supply path 24, and is conveyed to the hopper 201*a* of the apparatus main assembly 100 by the screw 27 in the toner supply path 24.

[Method for Replacing Refill Toner Container]

Next, the method for replacing the refill toner container 1 in accordance with the present invention will be described.

As approximately the entire amount of the toner within the toner bottle 1 is consumed by the image-formation process, the absence of the toner in the toner bottle 1 is detected by a detecting means (unshown) disposed in the apparatus main assembly 100 to detect the depletion of the toner in the toner bottle 1. This information is given to a user by a displaying means 100*b* (FIG. 2) such as a liquid crystal panel, etc.

The toner bottle 1 in this embodiment is replaced by the user him/herself. The replacement steps are as follows.

Figure 6:
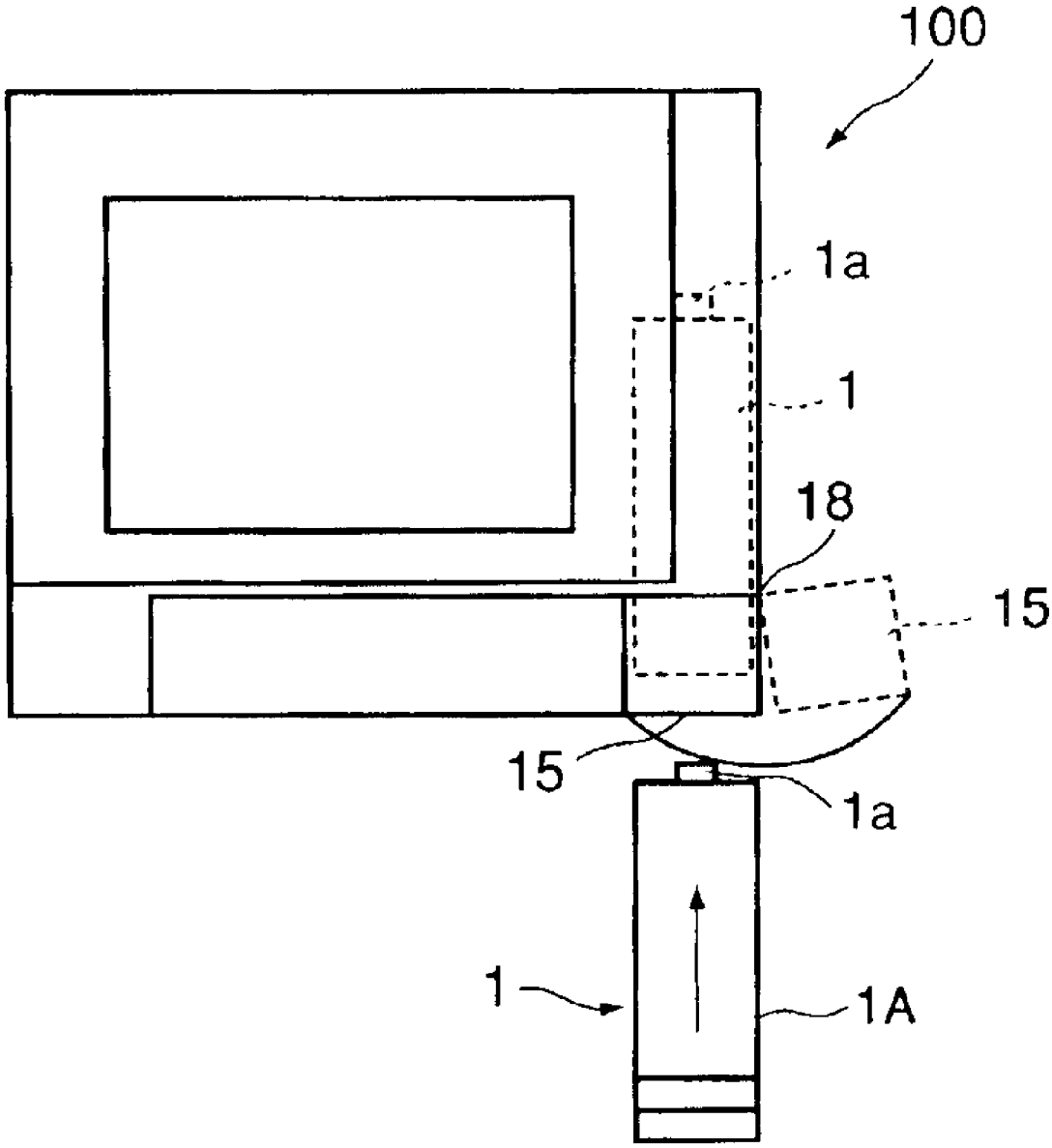
FIG. 6 is a plan view of the image forming apparatus, the refill toner container replacement cover of which is open.

First, the refill-container replacement cover 15, which is in the closed position, is to be rotated about a hinge 18 until it reaches the position indicated by the broken line in FIG. 6. As the refill-container replacement cover 15 is opened, the bottle main structure 1A in the state shown in FIG. 7(C) is moved in the direction indicated by an arrow mark a in FIG. 7(A), that is, the direction opposite to the direction indicated by the arrow mark b, by a toner-outlet opening/closing means, the movement of which is linked to that of the refill-container replacement cover 15, and which will be described later. As a result, the sealing member 2, which remained separated from the bottle main structure 1A, having therefore not been sealing the opening of the toner outlet 1*a*, is pressed into the opening of the toner outlet 1*a*, sealing the opening of the toner outlet 1*a*; the state shown in FIG. 7(B) is restored.

Next, the user is to pull the empty toner bottle 1 in the apparatus main assembly 100 in the direction opposite to the direction of the arrow mark a in FIG. 7(A), that is, the direction of the arrow mark b in FIG. 7(C) in order to remove the toner bottle 1 from the apparatus main assembly 100.

Thereafter, the user is to insert a fresh refill-toner bottle 1 into the apparatus main assembly 100 in the direction of the arrow mark a in FIG. 7(A), and close the refill-container replacement cover 15. As the refill container replacement cover 15 is closed, the sealing member 2 is separated from the bottle main structure 1A by the toner-outlet opening/closing means, the movement of which is linked to that of the refill-container replacement cover 15, as described above. As a result, the opening of the toner outlet 1*a* is sealed (FIG. 7(C)). The above are the refill-toner-container (toner bottle) replacement steps.

[Refill Toner Bottle]

Figure 8:
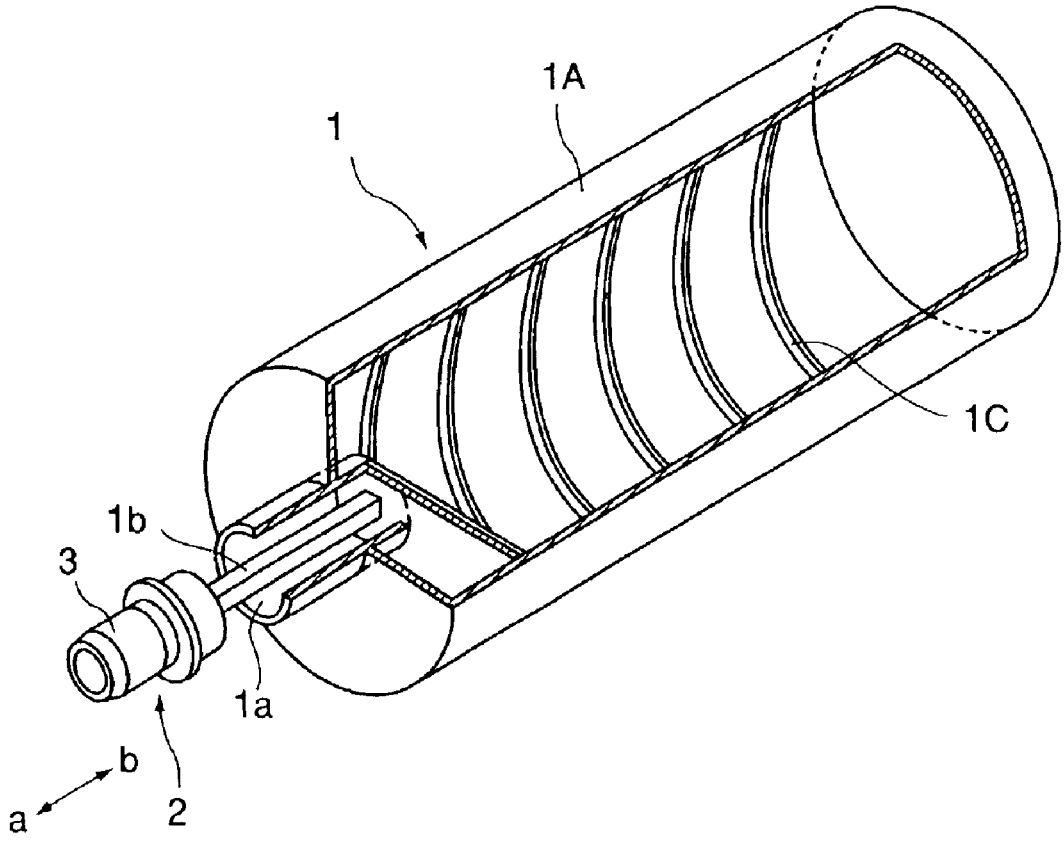
FIG. 8 is a partially broken away perspective view of the first embodiment of the refill toner container in accordance with the present invention.
Figure 9:
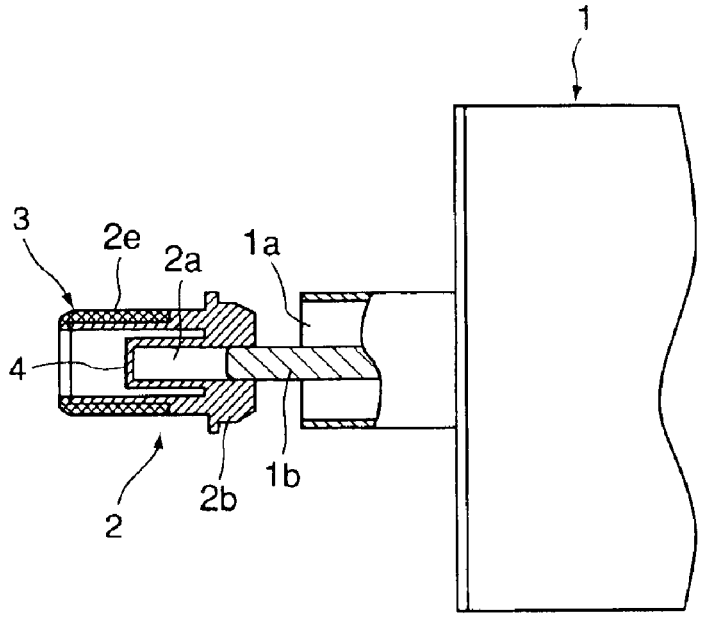
FIG. 9 is an enlarged sectional view of the driving-force transmission mechanism in the first embodiment of the present invention, the drive shaft of which is provided on the refill toner container side.

Next, referring to FIGS. 8 and 9, the refill-toner bottle in this embodiment will be further described.

The toner bottle 1 is approximately cylindrical, and is provided with the toner outlet 1*a*, which projects from the approximate center of one of the end surfaces of the toner bottle 1. The toner outlet 1*a* is also cylindrical, and its diameter is smaller than the cylindrical bottle main structure 1A. The toner outlet 1*a* is provided with the sealing member 2 for sealing the opening of the toner outlet 1*a*. As is evident from the descriptions provided with reference to FIGS. 7(A)~7(C), the toner outlet 1*a* is opened or closed by sliding this sealing member 2 in the axial direction of the toner bottle 1 (direction of arrows a–b).

The sealing member 2 comprises an elastically deformable driving-force receiving portion 3, and a disengagement portion 4 for disengaging the driving-force receiving portion 3 from the driving portion 20 of the apparatus main assembly. The two portions 3 and 4 are on the apparatus-main-assembly side of the sealing member. The driving-force receiving portion 3 is structured so that it couples with the driving portion 20 of the image-forming-apparatus main assembly and transmits rotational driving force to the toner bottle 1. The structures of the driving-force receiving portion 3 and disengagement portion 4 will be described later in more detail.

First, the internal structure of the toner bottle 1 will be described.

As described above, the toner bottle 1 is approximately cylindrical. It is approximately horizontally disposed in the apparatus main assembly 100. It is structured so that it rotates as it receives rotational driving force from the apparatus main assembly 100. Referring to FIG. 8, the internal wall of the toner bottle 1 is provided with a spiral rib 1*c*. Therefore, as the toner bottle 1 is rotated, the toner is conveyed in the axial direction, following the spiral rib 1*c*, and is discharged from the opening of the toner outlet 1*a*.

Although the toner bottle 1 in this embodiment is shaped so that as the toner bottle 1 rotates, the toner is discharged from the toner bottle 1, and the shape and structure of the toner bottle 1 does not need to be limited to those in this embodiment; it is optional.

In other words, the gist of the present invention is that the driving-force receiving portion of the toner bottle 1, which discharges toner as it rotates by receiving driving a force, and the driving-force transmitting portion of the apparatus main assembly 100, are provided with innovative characteristics. The internal structure of the toner bottle 1 may be one of the known structures, such as the one in this embodiment, in which the spiral rib 1*c* is provided in the toner bottle 1, or may be different from the known structures.

Figure 11:
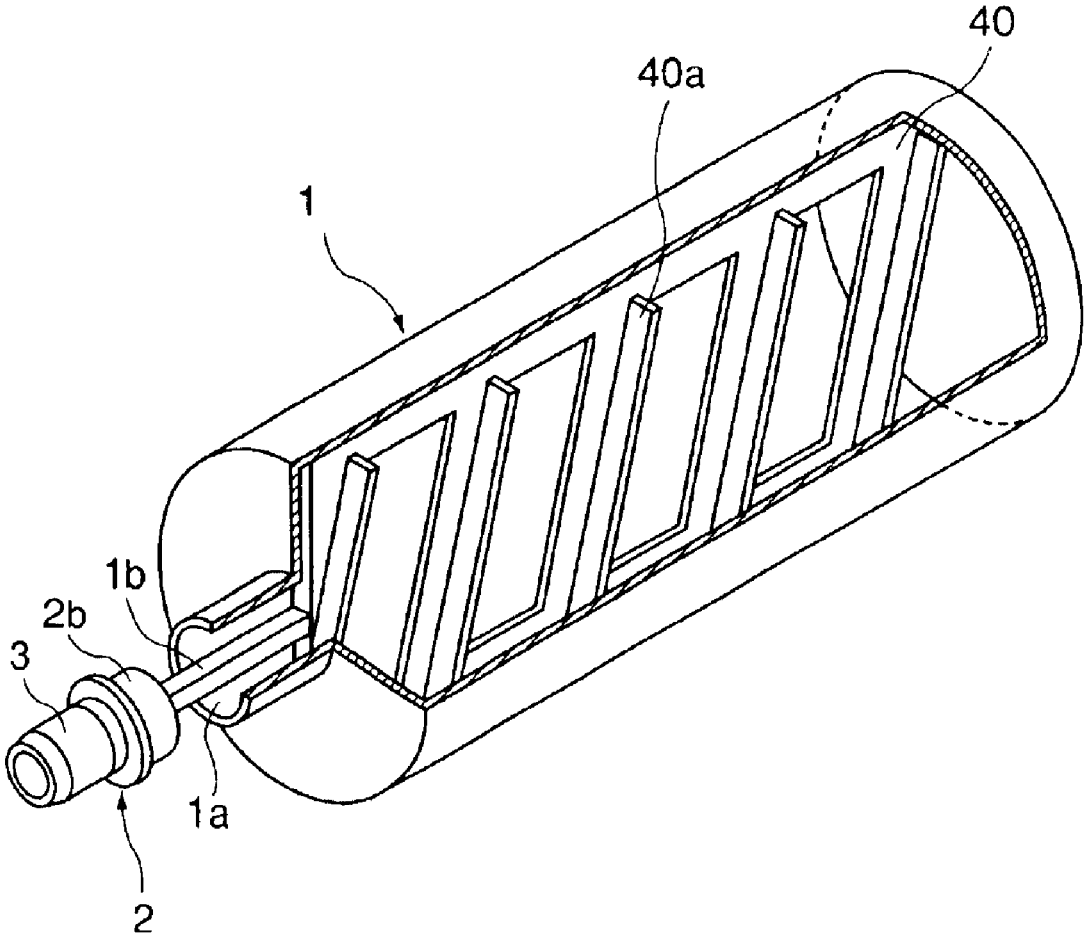
FIG. 11 is a partially-broken away perspective view of the refill toner container in another embodiment of the present invention.
Figure 12:
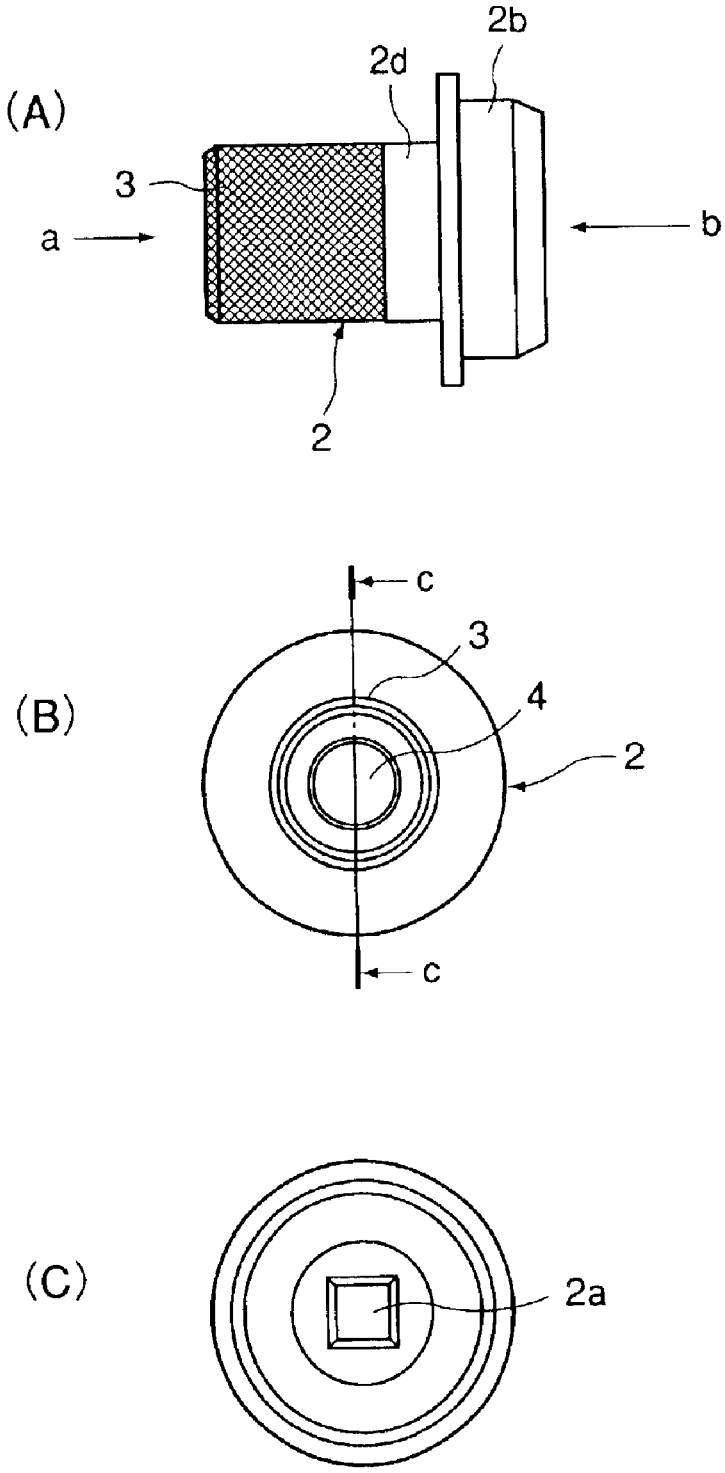
FIGS. 12(A) and 12(B) are respectively, a front view of the sealing member in the first embodiment of the present invention, and a side view of the sealing member in FIG. 12(A), as seen from the direction indicated by an arrow mark a in FIG. 12(A), respectively.
FIG. 12(C) is a view seen from the direction indicated by arrow b shown in FIG. 12(A).

For example, the internal structure of the toner bottle 1 may be the structure shown in FIG. 11, which is a modification of the structure in this embodiment. In this modification of the structure in this embodiment, a baffling member 40 in the form of a piece of plate is disposed within the toner bottle 1. More specifically, one of the surfaces of the baffling member 40 is provided with a plurality of ribs 40*a* slanted relative to the axial direction of the toner bottle 1. The slanted rib 40*a* closest to the toner outlet 1*a* is in contact with the toner outlet 1 by one of its lengthwise ends. Thus, as the toner reaches this slanted rib 40*a* closest to the toner outlet 1*a*, it is discharged through the toner outlet 1*a*. As for the principle of the toner-discharging mechanism of this modification, as the toner bottle 1 rotates, a certain amount of the toner is scooped up by the baffling member 40, and then, slides down on the surface of the baffling member 40, being guided by the slanted ribs 40*a*. As these actions are repeated, the entirety of the toner in the toner bottle 1 is gradually forwarded to the toner outlet 1*a* while being stirred. As a result, the toner is gradually discharged from the opening of the toner outlet 1*a*.

The method for driving the toner bottle 1 does not need to be rotational as is in this embodiment, as long as it can drive the toner bottle 1 so that the toner within the toner bottle 1 is gradually supplied to the apparatus main assembly 100. For example, the toner bottle 1 may vibrated or oscillated. In other words, as long as the toner bottle 1 is structured so that it discharges the toner therein as it receives some form of driving force, the form of driving force does not matter; the driving force may be rotational, vibratory, oscillatory, etc.

Referring to FIGS. 8 and 9, as described above, one of the end walls of the bottle main structure 1A is provided with the toner outlet 1*a*, through which the drive shaft 1*b* is extended outward. The drive shaft 1*b* is integral with the bottle main structure 1A. The axial line of the drive shaft 1*b* approximately coincides with that of the toner outlet 1*a*. The drive shaft 1*b* fits in the center hole 2*a* of the sealing member 2. Since the drive shaft 1*b* is for transmitting rotational driving force from the apparatus main assembly 100 to the bottle main structure 1A through the sealing member 2, its cross section is in the form of a square, H, D, etc., so that the rotational driving force can be transmitted. The means for securely fixing the drive shaft 1*b* to the bottle main structure 1A is optional.

Figure 10:
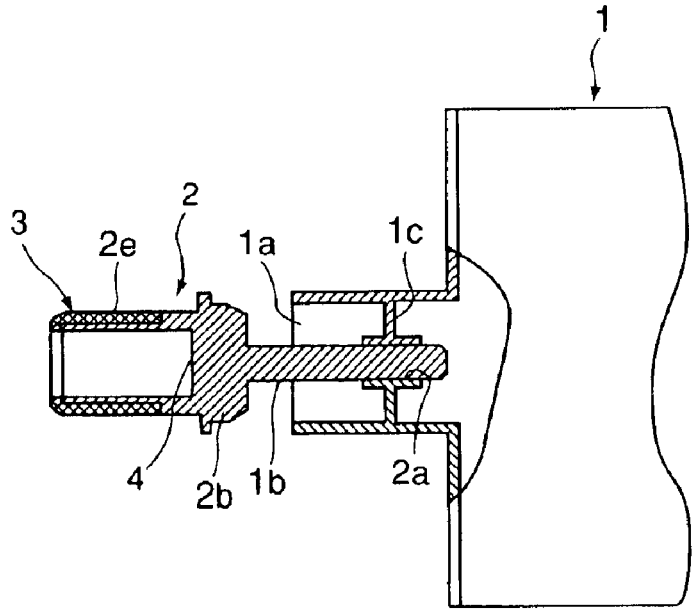
FIG. 10 is an enlarged sectional view of the driving-force transmission mechanism in another embodiment of the present invention, the drive shaft of which is provided on the sealing-member side.

The drive shaft 1*b* may be formed as an integral part of the sealing member 2 as shown in FIG. 10, instead of being securely fixed to the bottle main structure 1A. In such a case, the hole 2*a*, through which the drive shaft 1*b* is put, must be provided on the toner-bottle side of the sealing member 2. In the case of the modification shown in FIG. 10, the hole 2*a* is made in an internal structural member 1*z* of the toner outlet 1*a*.

In this embodiment, a design in which the drive shaft is solidly attached to the bottle main structure 1A was employed.

[Sealing Member]

Next, referring to FIGS. 12(A)-12(C) and 13, the sealing member 2 will be further described.

As shown in FIGS. 12(A)-12(C) and 13, the sealing member 2 comprises a sealing portion 2*b* for unsealably sealing the opening of the toner outlet 1*a* of the toner bottle 1. The external diameter of the sealing portion 2*b* is made larger by an appropriate amount than the internal diameter of the opening of the toner outlet 1*a*. As the sealing portion 2*b* is pressed into the opening of the toner outlet 1*a*, the opening of the toner outlet 1*b* is airtightly sealed by the sealing member 2.

As described above, the sealing member 2 has the hole 2*a*, through which the drive shaft 1*b* is put to receive driving force from the apparatus main assembly 100. This hole 2*a* is on the sealing-portion side. Its cross section corresponds in shape to that of the drive shaft 1*b*, and is slightly larger than that of the drive shaft 1*b*. Thus, the drive shaft 1*b* loosely fits in the hole 2*a*. The shape of the cross section of the hole 2*a* is identical to that of the drive shaft 1*b*, and is polygonal. In this embodiment, it is square.

As the drive shaft 1*b* is loosely fitted in the hole 2*a*, the bottle main structure 1A is locked with the sealing member 2 in terms of the rotational direction of the bottle main structure 1A while being allowed to move relative each other in terms of their axial directions. With the provision of the above-described structural arrangement, when mounting the toner bottle 1 into the toner-supplying apparatus 400, the sealing member 2 can be separated from the bottle main structure 1A to unseal (expose) the opening, that is, toner delivery opening, of the toner outlet 1*a*.

The length by which the drive shaft 1*b* is inserted into the hole 2*a* is such that the drive shaft 1*b* does not completely comes out of the hole 2*a* as the sealing member 2 is separated from the bottle main structure 1A. Therefore, even after the separation of the sealing member 2 from the bottle main assembly 1A, the drive shaft 1*b* can receive the driving force through the sealing member 2.

Figure 13:
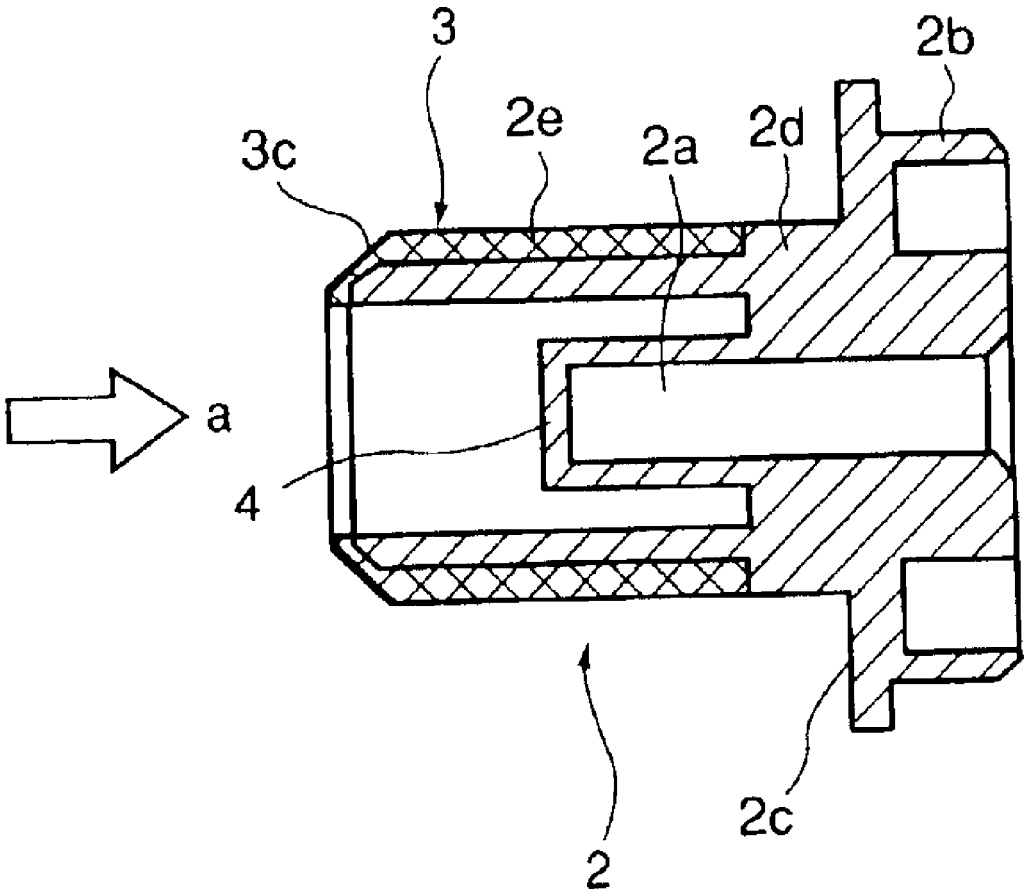
FIG. 13 is a sectional view of the sealing member in FIG. 12, at a plane represented by the line c—c in FIG. 12(B).

Also as described above, the sealing member 2 is provided with the driving-force receiving portion 3. The material therefor is an elastically deformable substance, for example, plastic such as low density polyethylene, synthetic rubber, thermoplastic elastomer, etc. The driving-force receiving portion 3 does not need to be a single member. For example, it may consists of two or more pieces as shown in FIG. 13. In this case, it is formed by two color molding or the like, and the peripheral portion of the end portion of its cylindrical portion is formed of elastic material such as plastic, elastomer, etc.

When the driving portion 20 of the apparatus main assembly 100 is formed of solid substance, such metal which is least likely to elastically deform, the driving-force receiving portion 3 is desired to be formed of an elastically deformable plastic or elastomer, so that when it is engaged with the driving portion 20 of the apparatus main assembly 100, a proper amount of reactive force is generated due to compressional deformation to ensure the engagement in order to ensure the transmission of the driving force.

Further, the portion of the driving portion 20 of the apparatus main assembly 100 that directly contacts the driving-force receiving portion 3 is desired to be formed of elastically deformable plastic, elastomer, or the like, so that a larger amount of friction is generated between the driving portion 20 and driving-force receiving portion 3 to ensure that that driving force is reliably transmitted. The driving-force receiving portion 3 formed of elastic substance is pressed into the cylindrical driving portion 20, and as it is pressed into the cylindrical driving portion 20, the aforementioned reactive force is generated in the portion of the driving-force receiving portion 3 in the cylindrical driving portion 20 due to the resiliency of the elastic substance, assuring the driving-force transmitting engagement between the two portions 3 and 20.

Figure 15:
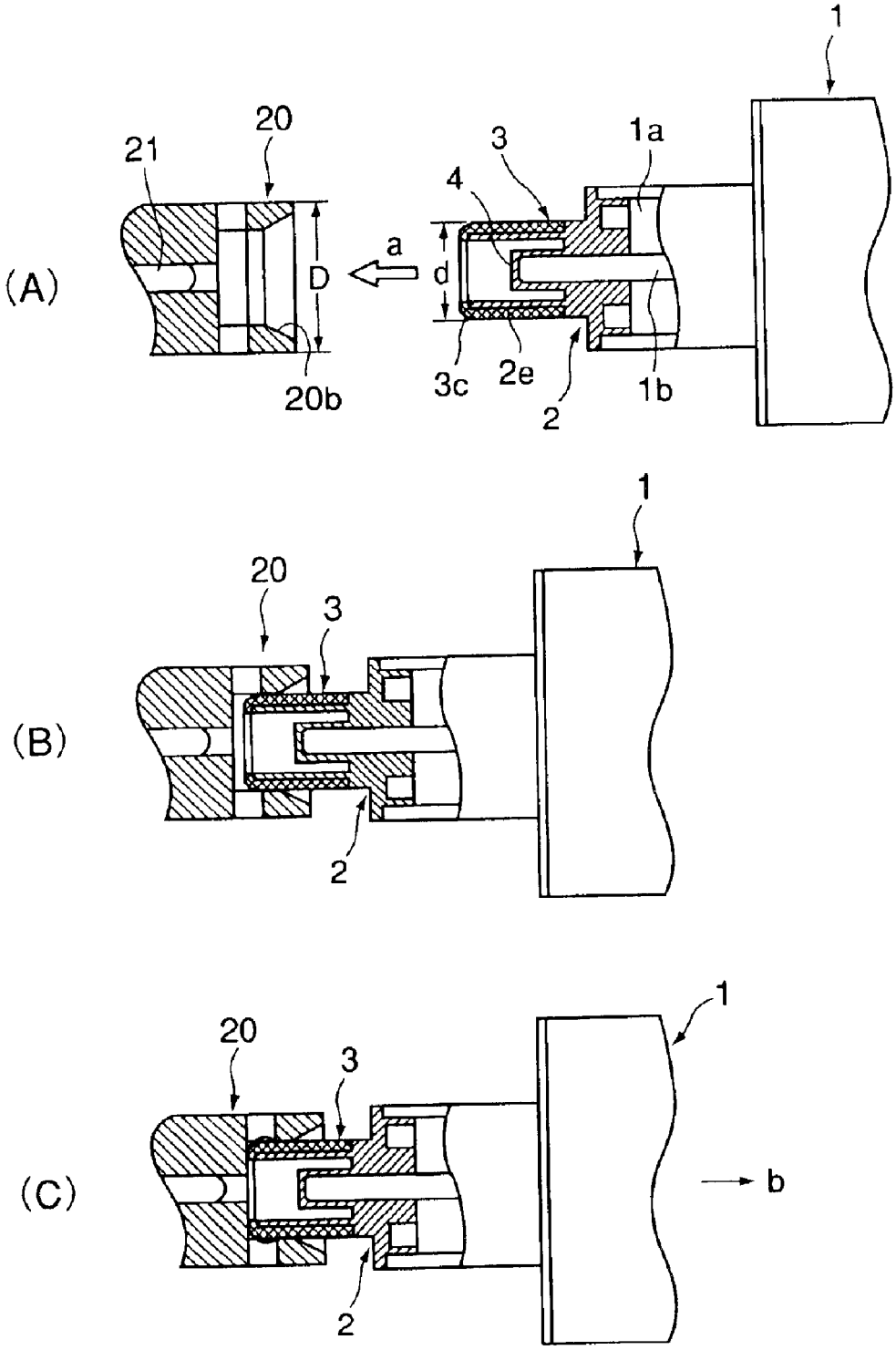
FIG. 15 is a sectional view of the combination of the driving-force transmitting portion and the driving-force receiving portion shown in FIG. 14, for showing the actions therein during the refill toner container insertion, (A), (B), and (C) being the pre-insertion, mid, and final stages thereof, respectively.

Further, referring to FIG. 13, the sealing member 2 is also provided with a disengagement force receiving portion (disengagement portion) 4 for dissolving the engagement between the sealing member 2 and the driving portion 20 of the apparatus main assembly 100. The position of the disengagement portion 4 is optional; it may be decided according to the structure of the apparatus main assembly. For example, referring to FIG. 15, when the sealing member 2 is structured so that a pushing member 21, which is activated from the apparatus-main-assembly side, pushes inward the sealing member 2, the disengagement portion 4 can be positioned in the driving-force receiving portion 3 as shown in FIGS. 13 and 15. In this case, the end portion of the sealing member 2, that is, the driving-force receiving portion 3 is made hollow. The details of this structural arrangement will be further described later with reference to FIG. 15.

Figure 17:
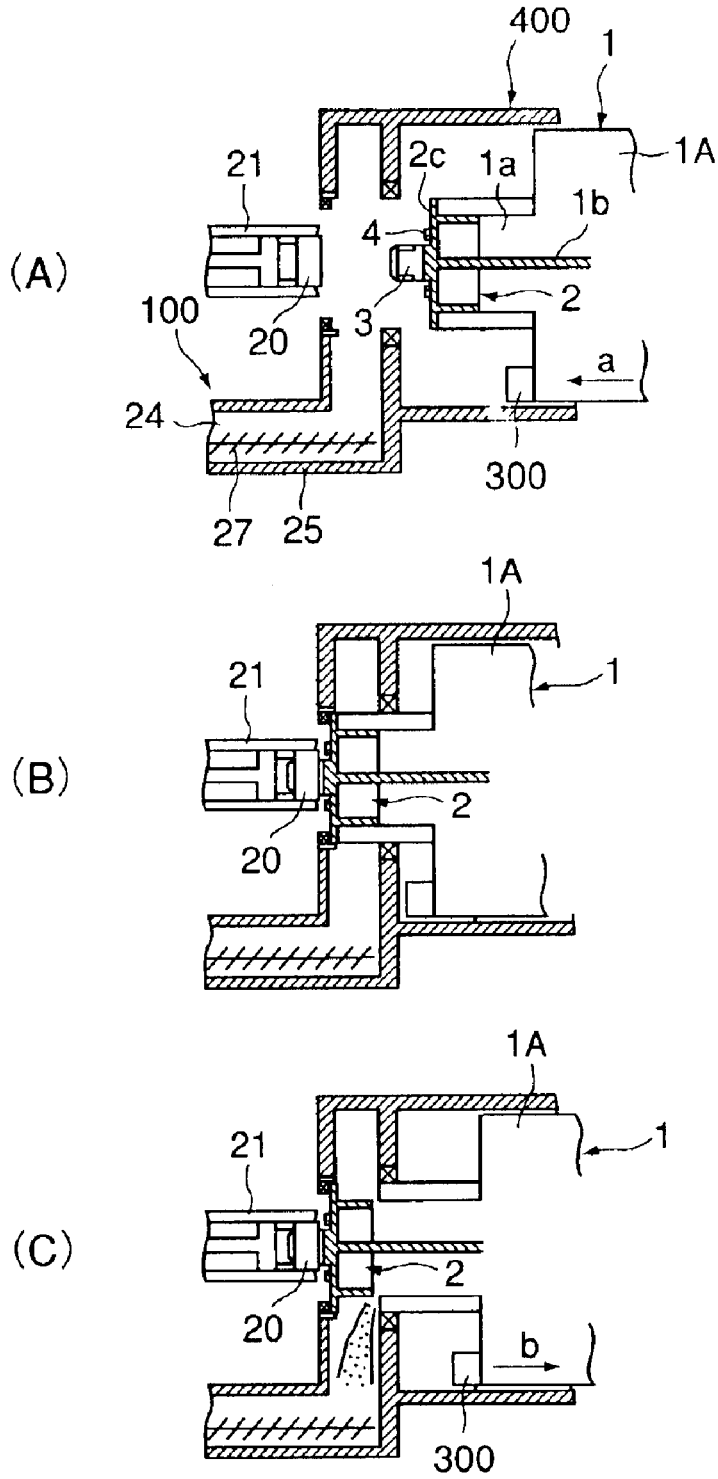
FIG. 17 is a sectional view of the combination of the driving-force transmitting portion of the main assembly and the driving-force receiving portion of the refill toner container, in another embodiment of the present invention, for showing the mounting of the refill toner container, (A), (B), and (C) being the initial, mid, and final stages thereof, respectively.
Figure 18:
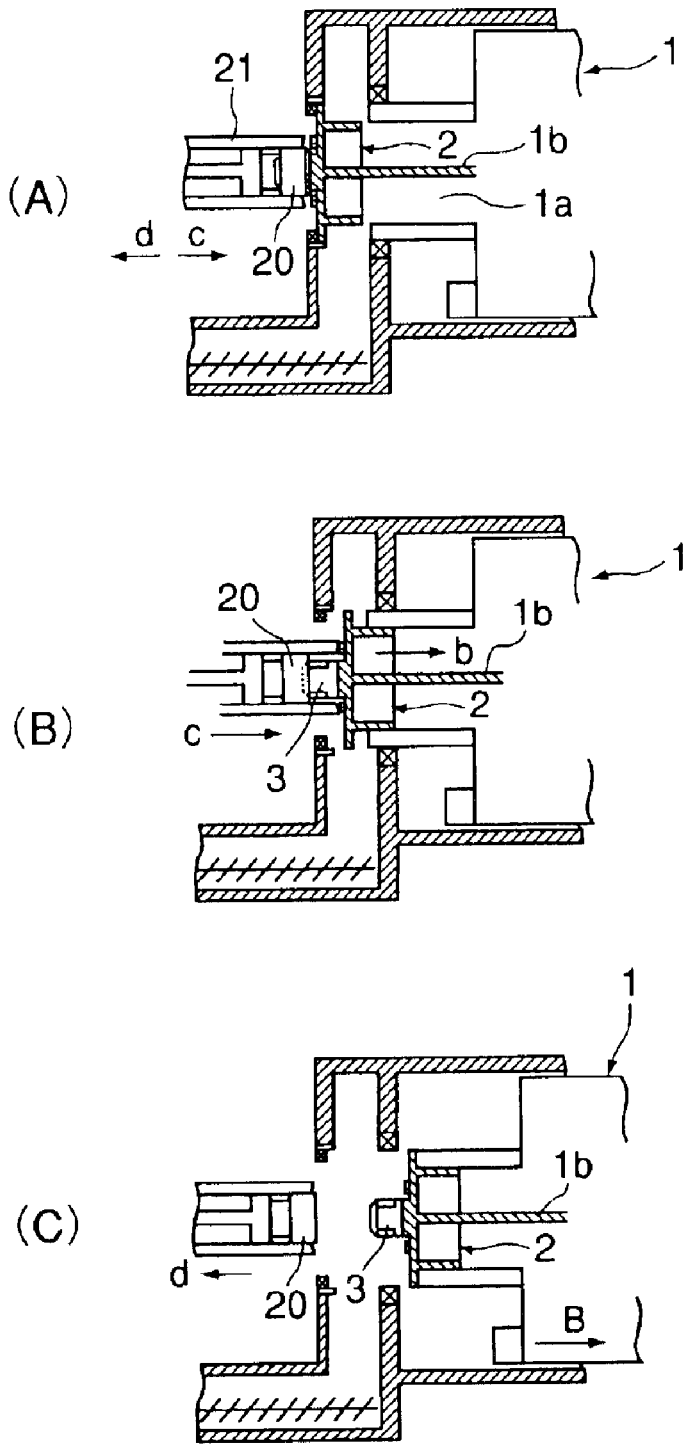
FIG. 18 is a sectional view of the combination of the driving-force transmitting portion of the main assembly and the driving-force receiving portion of the refill toner container, shown in FIG. 17, for showing the actions thereof during the disengagement thereof, (A), (B), and (C) being the pre-disengagement, mid, and final stages thereof, respectively.

On the contrary, when the pushing member 21 is structured, as shown in FIGS. 17 and 18, that it pushes the periphery of the driving-force receiving portion 3, in other words, it is disposed around the driving portion 20, the disengagement portion 4 can be provided on the flange portion 2*c* of the sealing member 2*c*. This structural arrangement will be described later as the second embodiment. Even in this case, the steps in the engagement or disengagement process between the driving portion 20 and driving-force receiving portion 3 are the same as those that also will be described later.

[Structure of Driving Force Transmission Mechanism]

Next, referring to FIG. 14, the driving-force transmission mechanism, which best characterizes the present invention, will be described. The driving-force transmission mechanism comprises the driving portion 20 belonging to the apparatus main assembly 100 and the driving-force receiving portion 3 belonging to the sealing member 2.

The sealing member 2 in this embodiment comprises the cylindrical driving-force receiving portion 3, by which it receives the driving force from the driving-force transmitting portion of the toner-supplying apparatus 400. The relationship between the internal diameter D of the driving portion 20 and the external diameter d of the driving-force receiving portion 3 is: D<d.

As described before, the driving-force receiving portion 3 of the sealing member 2 is made elastically deformable so that as it is subject to pressure, it easily and elastically deforms. Further, the sealing member 2 also comprises the disengagement portion 4.

On the other hand, the driving portion 20 belonging to the image-forming-apparatus main assembly is structured so that it engages with the driving force receiving portion 3 of the sealing member 2. The lip portion of the driving portion 20 is chamfered on the inward edge, being therefore provided with a conic surface 20*b*, so that the sealing member 2 can easily enter the driving portion when the toner bottle 1 is mounted into the toner-supplying apparatus 400. Also, the edge of the end of the sealing member 2 is chamfered, having therefore a conic surface 3*c*. With the presence of these conic surfaces 3*c* and 20*b*, the sealing member 2 smoothly enters the driving portion 20.

Figure 14:
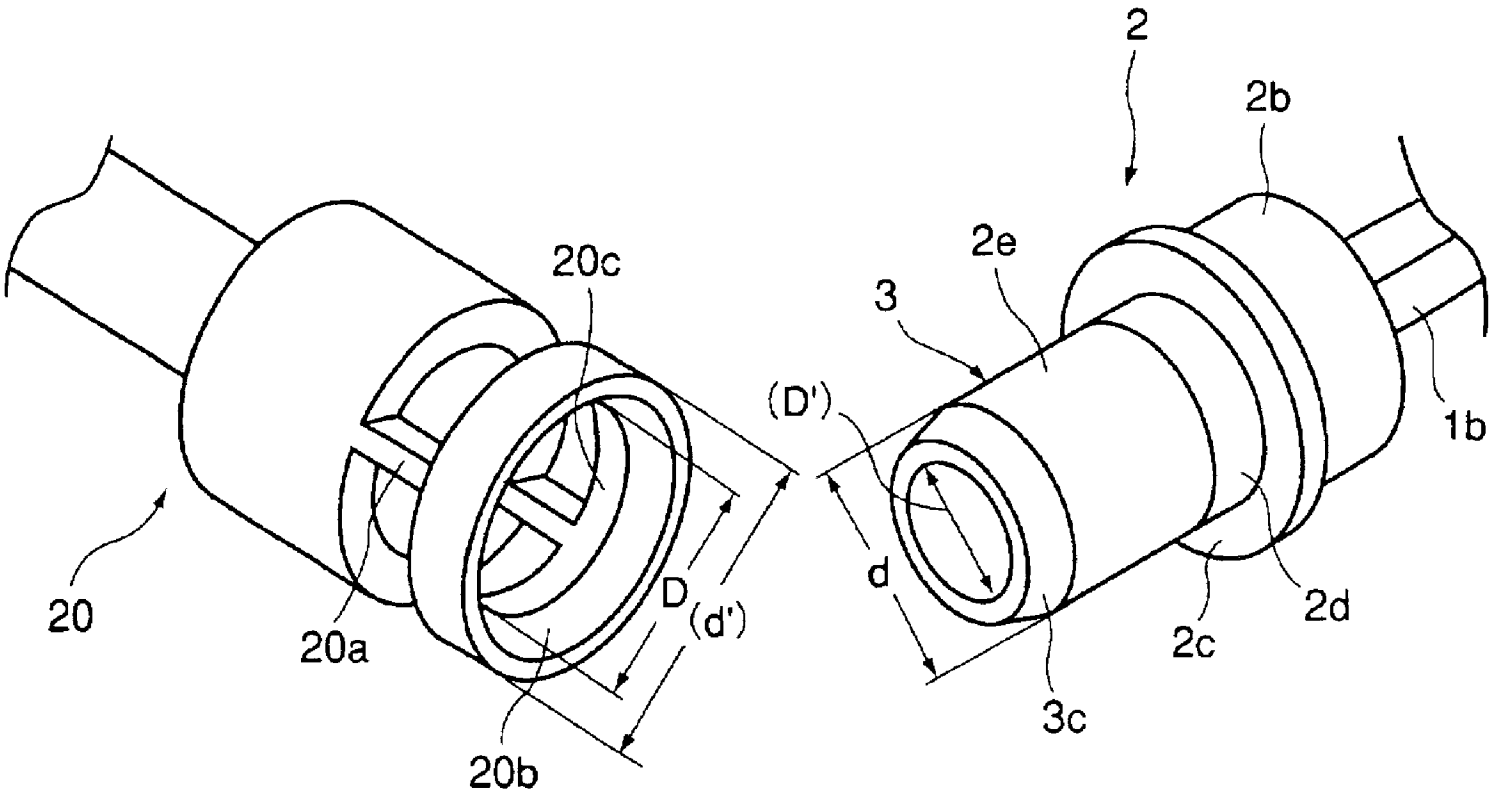
FIG. 14 is a perspective view of the combination of the driving-force transmitting portion and driving-force receiving portion in the first embodiment of the present invention, which does not require phase synchronization.

Referring to FIG. 14, the driving portion 20 is provided with an engagement rib 20*a*, for the following purpose: With the provision of the engagement rib 20*a*, as the driving portion 20 and driving-force receiving portion 3 are engaged, the peripheral elastic portion 2*e* of the driving-force receiving portion 3 elastically expands in a manner to conform to the contour of the engagement rib 20*a*, locking onto the engagement rib 20*a*, and therefore, securing the engagement between the driving portion 20 and driving-force receiving portion 3.

Next, referring to FIG. 15, it will be described how the driving portion 20 and the sealing member 2 in this embodiment engage each other.

FIG. 15(A) shows how a user is supposed to insert the toner bottle 1 into the main assembly of the copying machine in the direction indicated by an arrow mark, in order to properly set the toner bottle 1 in the main assembly. More specifically, it shows the toner bottle 1 which is about to be engaged with the driving portion 20 in the image-forming-apparatus main assembly.

Also referring to FIG. 15(A), as the toner bottle 1 is moved further in the direction indicated by an arrow mark a, the driving-force receiving portion 3 of the sealing member 2 first comes into contact with the conic surface 20*b* of the driving portion 20 of the apparatus main assembly 100, and then, enters the driving portion 20 while being guided by the conic surface 20*b*, and is gradually and elastically compressed in its radius direction, by the conic surface 20*b*, as shown in FIG. 15(B).

As the toner bottle 1 is further inserted, the driving-force receiving portion 3 completely engages with the driving portion 20 of the apparatus main assembly 100 (FIG. 15(C)). In this state shown in FIG. 15(C), the engagement between the driving-force receiving portion 3 and the driving portion 20 of the apparatus main assembly 100 is secure, and the position of the sealing member 2 in terms of the thrust direction (axial direction) is fixed.

However, when the driving portion 20 is formed of an elastic substance or the like, the driving portion 20 itself deforms, and grips onto the driving-force receiving portion 3 due to its elasticity. Thus, even when the toner bottle 1 is thereafter retracted in the direction indicated by an arrow mark b (FIG. 15(C)), the sealing member 2 remains securely attached to the driving portion 20 of the apparatus main assembly 100; in other words, only the toner bottle 1 is retracted. Therefore, it is assured that the sealing member 2 is separated from the toner bottle 1 to open the toner outlet 1*a*.

Incidentally, the apparatus main assembly 100 may be structured so that the toner bottle 1 is slidably moved by an unshown mechanism, the movement of which is linked to the opening/closing movement of the refill-container replacement cover 15 of the image-forming-apparatus main assembly.

[Method for Disengaging Driving Force Receiving Portion]

Next, referring to FIG. 16, the method for disengaging the driving-force receiving portion 3 will be described.

As the toner bottle 1 becomes empty due to the refill toner delivery therefrom, the empty toner bottle 1 must be replaced with a fresh refill-toner bottle 1. In order to replace the empty toner bottle 1 with a fresh one, the engagement between the sealing member 2 and the driving portion 20 must be dissolved.

Figure 16:
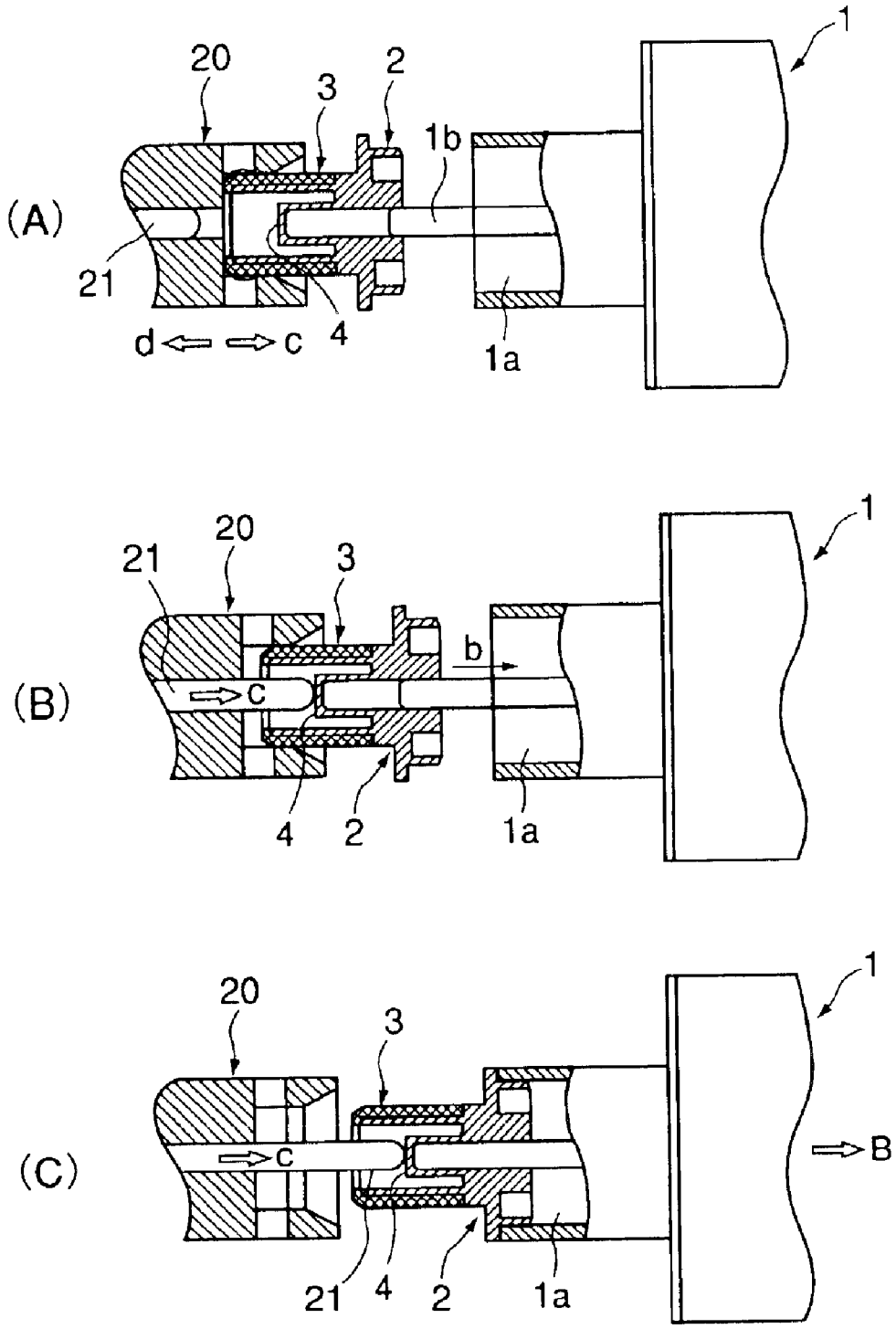
FIG. 16 is a sectional view of the combination of the driving-force transmitting portion on the main-assembly side and the driving-force receiving portion on the refill toner container side, for showing the actions thereof during the disengagement thereof, (A), (B), and (C) being the pre-disengagement, mid, and final stages thereof, respectively.

Referring to FIG. 16, there is a pushing member 21 in the apparatus main assembly 100, more specifically, in the driving portion 20. The pushing member 21 is structured so that it can be moved in the same direction (direction indicated by arrow marks c–d) as the axial line of the driving shaft 1*b* of the toner bottle 1.

FIG. 16(A) shows the toner outlet 1*a* of the toner bottle 1, which is open after the depletion of the refill toner in the toner bottle 1.

The engagement between the driving portion 20 and sealing member 2 is dissolved in the following manner: First, the pushing member 21 is to be advanced, in the direction indicated by an arrow mark c, to push the disengagement portion 4 within the hollow of the sealing member 2, as shown in FIG. 16(B). As a result, the sealing member 2 is moved in the direction of the arrow mark b, dissolving the engagement between the driving-force receiving portion 3 and the driving portion 20 of the apparatus main assembly. Then, as the pushing member 21 is further advanced in the direction of the arrow mark c, the sealing member 2 is pressed into the toner outlet 1*a* of the toner bottle 1 by the pushing member 21 as shown in FIG. 16(C), airtightly sealing the toner outlet 1*a*. As the pushing member 21 is advanced even further in the direction of the arrow mark c, it makes the entirety of the toner bottle slide back in the direction indicated by an arrow mark B to a point at which the toner bottle 1 can be easily removed by a user.

The structure of the mechanism for driving the pushing member 21 is optional. For example, the movement of the pushing member 21 may be linked to the movement of the refill-container replacement cover 15 of the apparatus main assembly 100 so that as the front this cover is opened, the pushing member 21 is moved in the arrow c direction to disengaging the sealing member 2 of the toner bottle 1 from the driving portion 20, and also, so that as the cover 15 is closed, the pushing member 21 is moved in the arrow d direction; a motor dedicated for the movement of the pushing member 21 may be provided; a manual lever dedicated to moving the pushing member 21 may be provided, instead of linking the movement of the pushing member 21 to that of the cover 15 of the apparatus main assembly 100, etc. In other words, it does not matter.

As described above, according to this embodiment of the present invention, not only can the mechanism for transmitting the driving force to the toner bottle 1 be easily disengaged by a very simple operation of sliding the pushing member 21 forward or backward, but also the toner outlet 1*a* is opened or closed by the same simple operation at the same time. In other words, the driving-force transmission mechanism in this embodiment can reliably transmit the rotational driving force to the toner bottle 1 by a very simple operation, in spite of the simple, inexpensive, and compact structure thereof.

In this embodiment, the driving-force transmitting mechanism is structured so that the driving-force receiving portion 3 is pressed into the driving-force transmitting portion 20. However, the structural relation between the former and latter may be reversed. In other words, the driving-force transmitting mechanism may be structured so that the driving-force transmitting portion 20 is pressed into the driving-force receiving portion 3. In such a case, the relationship between the external diameter d' of the driving-force transmitting portion 20 and the internal diameter D' of the driving-force receiving portion 3 is: d'>D'.

However, sometimes, the engagement between the driving portion 20 and the driving-force receiving portion 3 becomes unstable due to the deterioration of the elasticity of the elastic member which occurs with the elapse of time. In consideration of this kind of situation, the elastic substance is desired to be used as the material for the replaceable component. For example, in this embodiment, the image forming apparatus is structured so that the refill toner container, which comprises the driving-force receiving portion, is replaced a certain number of times before the service life the image forming apparatus expires. Therefore, the elastic substance is desired to be used as the material for the driving-force receiving portion.

Embodiment 2

In the first embodiment, the disengagement portion 4 was an integral part of the sealing member 2, and was in the hollow of the sealing member 2. However, the disengagement portion 4 may be in the form of the flange 2*c* of the sealing portion 2*b*, as shown in FIG. 17.

Next, referring to FIGS. 17(A)–17(C), the operation for discharging refill toner from the toner bottle 1 will be described. The overall structure and operation of the toner-supplying apparatus in this embodiment are the same as those in the first embodiment. Therefore, they will not be described here, and only the toner discharging operation of the toner bottle 1, which characterizes this embodiment, will be described.

FIG. 17(A) shows the initial stage of the mounting of the toner bottle 1 into the apparatus main assembly 100. The toner bottle 1 is provided with the cylindrical toner outlet 1*a*, which is on the outward surface of one of the end walls of the toner bottle 1. The opening of the toner outlet 1*a* is sealed with the sealing member 2.

FIG. 17(B) shows the end of the mid stage of the toner-bottle mounting operation. In the mid stage, the toner bottle 1 is further inserted into the apparatus main assembly 100, and the driving-force receiving portion 3, or the end portion of the sealing member 2, engages with the driving portion 20 of the apparatus main assembly. In this case, the sealing member 2 is engaged with the driving portion 20 of the apparatus main assembly by the pressure applied to the toner bottle 1 by a user as the user inserts the toner bottle 1. Further, the sealing member 2 is locked, by its driving-force receiving portion 3, with the driving portion 20 of the apparatus main assembly, in terms of the thrust direction (axial direction). Therefore, unless this engagement is dissolved, the sealing member 2 remains fixed in position by the driving portion 20.

FIG. 17(C) shows the end of the final stage of the toner bottle mounting operation. In this stage, the sliding member 300 is retracted in the direction indicated by an arrow mark b, by the closing movement of the cover 15 for the toner-bottle replacement, forcing the toner bottle 1 to retract. As a result, the sealing member 2 is separated from the toner bottle 1 due to the relative movement of the sealing member 2 with respect to the toner bottle 1. Consequently, the toner outlet 1*a* is opened, enabling the refill toner within the toner bottle 1 to be discharged. In this stage, the drive shaft 2*b* fixed to the toner bottle main structure 1A does not become completely separated from the sealing member 2; a part of the driving shaft 1*b* remains within the sealing member 2.

As an unshown motor is activated in this state, the rotational driving force from the motor is transmitted to the sealing member 2 from the driving portion 20 of the apparatus main assembly. Then, it is transmitted from the sealing member 2 to the drive shaft 1*b* of the toner bottle 1, and rotates the toner bottle 1. In other words, this sealing member 2 performs two functions: not only does it seal the toner outlet 1*b*, but also transmits the rotational driving force to the toner bottle 1.

The toner-supplying steps which come after the above-described final stage are the same as those in the first embodiment.

Next, referring to FIG. 18, the method, in this embodiment, for disengaging the driving-force receiving portion 3 will be described.

Referring to FIG. 18(A), in this embodiment, the pushing member 21 is formed as a peripheral portion of the driving portion 20. The driving portion 20 is structured so that the pushing member 21 can be moved in the same direction (direction of arrows c–d) as that of the axial line of the drive shaft 1*b* of the toner bottle 1.

FIG. 18(A) shows the beginning of the initial stage of the toner-bottle-replacement operation. In this state, the toner outlet 1*a* is open after the discharging of the refill toner from the toner bottle 1. In other words, this state is the same as the state in FIG. 17(C).

The engagement between the driving portion 20 and sealing member 2 is dissolved in the following manner: First, the pushing member 21 is to be advanced in the direction indicated by an arrow mark c to push the disengagement portion 4, which is the flange portion 2*c* of the sealing member 2. As a result, the sealing member 2 is moved in the direction of the arrow mark b, dissolving the engagement between the driving-force receiving portion 3 and the driving portion 20 of the apparatus main assembly, as shown in FIG. 18(B). Then, as the pushing member 21 is further advanced in the direction of the arrow mark c, the sealing member 2 is pressed into the toner outlet 1*a* of the toner bottle 1 by the pushing member 21, airtightly sealing the toner outlet 1*a*. As the pushing member 21 is advanced even further in the direction of the arrow mark c, it makes the entirety of the toner bottle slide back in the direction indicated by an arrow mark B, as shown in FIG. 18(C), to a point at which the toner bottle 1 can be easily removed by a user. Thereafter, the driving portion 20 and the pushing member 21 return to their initial positions as shown in FIG. 18(C).

The structure of the mechanism for driving the pushing member 21 is optional. For example, the movement of the pushing member 21 may be linked to the movement of the cover 15 of the apparatus main assembly 100, as was in the first embodiment, so that as the cover 15 is opened, the pushing member 21 is moved in the arrow c direction to disengage the sealing member 2 of the toner bottle 1 from the driving portion 20, and also so that as the cover 15 is closed, the pushing member 21 is moved in the arrow d direction (18(C)); a motor dedicated for the movement of the pushing member 21 may be provided; a manual lever dedicated to moving the pushing member 21 may be provided, instead of linking the movement of the pushing member 21 to that of the cover 15 of the apparatus main assembly 100, etc. In other words, it does not matter.

Also in this embodiment, the effects similar to those in the first embodiment can be obtained.

Embodiment 3

Next, referring to FIG. 19, another embodiment of the refill toner container 1 in accordance with the present invention will be described.

Figure 19:
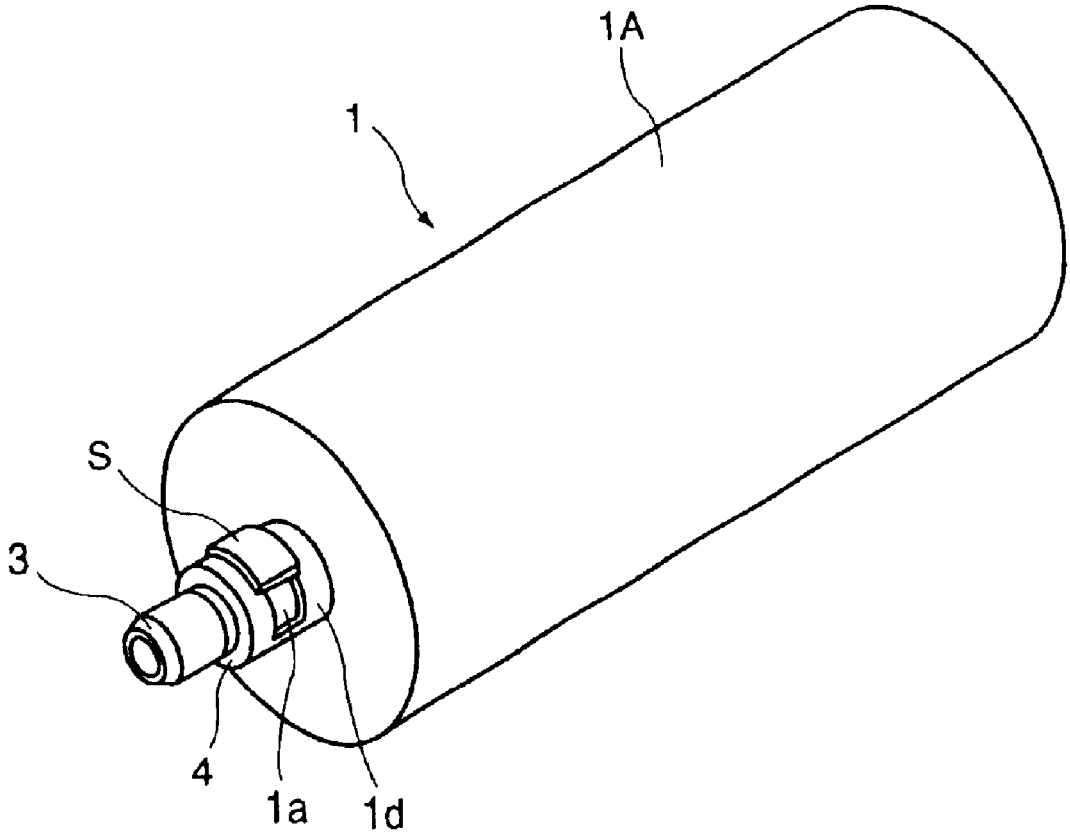
FIG. 19 is a perspective view of the refill toner container in another embodiment of the present invention.

Referring to FIG. 19, when the cylindrical toner outlet 1*d* is placed on the external surface of one of the end walls of the main structure 1A of the refill toner container 1, and the toner discharging opening 1*a* is placed in the cylindrical lateral wall of the toner outlet 1*d*, the driving-force receiving portion 3 may be directly attached to the end wall of the toner outlet 1*d*, instead of the above-described sealing member 2. In such a case, the opening 1*a* is sealed or unsealed with a shutter S.

In this embodiment, the disengagement portion 4 is a part of the end wall of the cylindrical toner outlet 1*d*, more specifically, the doughnut-shape portion which surrounds the base of the driving-force receiving portion 3.

As for the method, in this embodiment, for connecting the refill toner container 1 to the driving portion 20 of the apparatus main assembly, all that is necessary is to insert the driving-force receiving portion 3 into the driving portion 20 of the apparatus main assembly as in the first and second embodiments, since the driving-force receiving portion 3 and the disengagement portion 4 in this embodiment are also disposed on the external surface of one of the end walls of the bottle main structure 1A as are in the first and second embodiments.

As for the method for dissolving the engagement, all that is necessary is for the pushing member 21 to push the disengagement portion 4 as in the second embodiment.

Also in this embodiment, the effects similar to those in the first and second embodiments can be obtained.

Embodiment 4

Next, referring to FIGS. 20 and 21, another embodiment of the present invention will be described.

Figure 20:
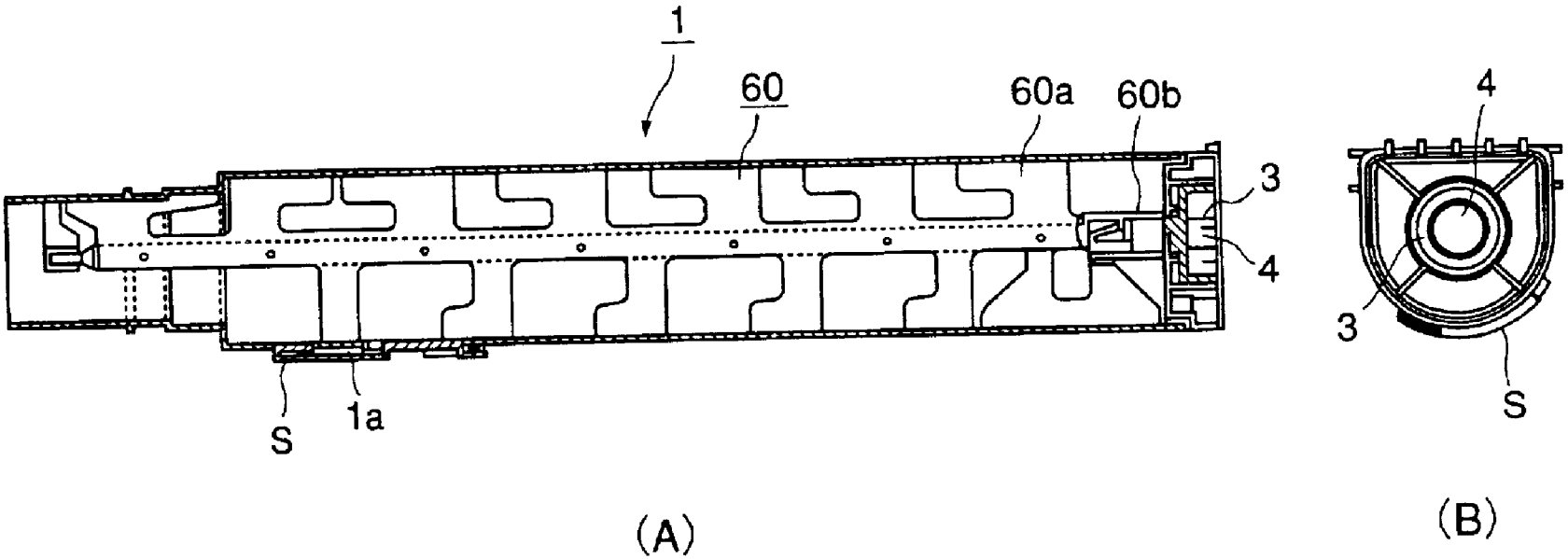
FIG. 20 is a perspective view of the refill toner container in another embodiment of the present invention.

FIG. 20 shows the refill toner container 1 in this embodiment. As shown in FIG. 20, there is disposed a stirring member 60 within the main structure 1A of the refill toner container 1. The stirring member 60 comprises a plurality of stirring plates 60*a* and a shaft 60*b*.

Figure 21:
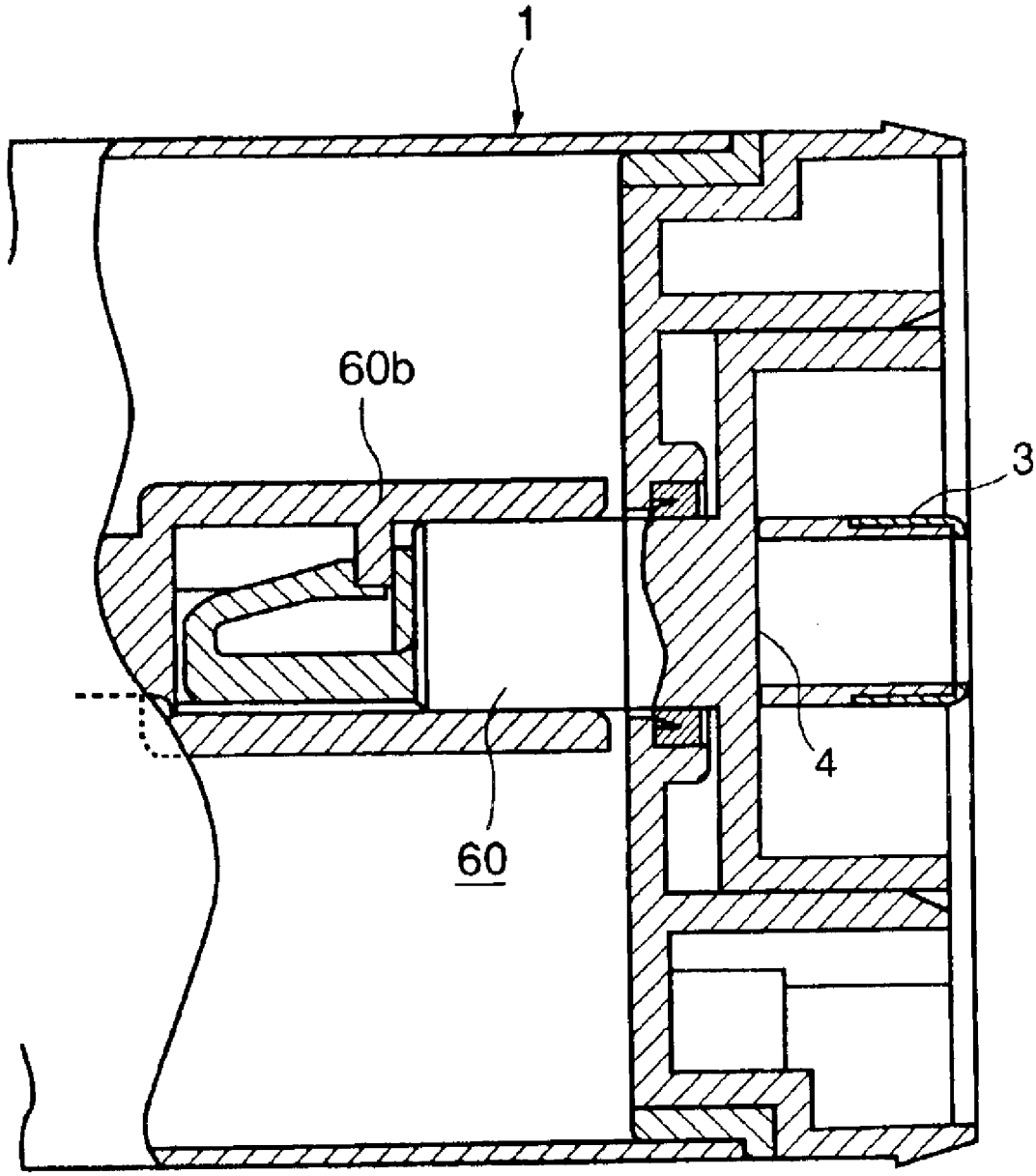
FIG. 21 is a detailed sectional view of the driving-force receiving portion of the refill toner container in FIG. 20.

To one end of the shaft 60*b*, the driving-force receiving portion 3 and the disengagement portion 4 are attached, as will be better understood with reference to FIG. 21. The driving-force receiving portion 3 can be engaged with, or disengaged from, the driving portion 20 of the apparatus main assembly.

Also in this embodiment, all that is necessary to engage the refill toner container 1 with the driving-portion of the apparatus main assembly is to insert the driving force receiving portion 3 into the driving portion 20 of the apparatus main assembly as is in the first embodiment.

Further, all that is necessary to disengage the refill toner container 1 from the driving portion 20 of the apparatus main assembly is for the pushing member 21 to push the disengagement portion 4.

Also in this embodiment, the phase synchronization mechanism for rotationally driving the stirring member 60 is unnecessary, making it possible to provide a driving-force transmission mechanism which is simple in structure.

In the above-described embodiments, a driving-force transmission mechanism in accordance with the present invention was employed as the driving-force transmission mechanism for the refill toner container and toner-supplying apparatus for an image forming apparatus. However, a driving-force transmission mechanism in accordance with the present invention can also be employed as an excellent mechanism for transmitting the rotational driving force to a photoconductive member removably mountable in an image forming apparatus. In such a case, a driving-force receiving portion with an elastic portion, such as the above-described one, is disposed on one of the end surfaces of a photoconductive member, and as the driving-force receiving portion is pressed into a driving-force transmitting member such as the above-described one, of an image forming apparatus, it becomes possible for the photoconductive member to be rotationally driven.

As is evident from the above description, the application of a driving-force transmission mechanism in accordance with the present invention is not limited to a refill toner container and a toner-supplying apparatus; it is also applicable to a wide range of structures for transmitting a driving force in the form of a rotation, a vibration, or an oscillation, along their axial lines.

The toner mentioned in this specifications of the present invention includes a single-component developer, toner in a two-component developer, etc. In the case of the toner in two-component developer, the "toner" may contain a carrier.

As described above, according to the above described embodiments of the present invention, at least the following effects can be obtained.

(1) The application of the driving-force transmission mechanism in any of the above-described embodiments of the present invention makes it possible to provide a simple and inexpensive driving-force transmission mechanism which does not require the phase synchronization between the driving-force transmitting portion and the driving-force receiving portion, and which is capable of transmitting a driving force in the form of a rotation, a vibration, and an oscillation, along its axial line.

(2) It eliminates the need for the phase synchronization, in terms of the rotational direction of a refill toner container, which the driving-force transmission mechanism in accordance with the prior art requires when replacing a refill toner container. In other words, all that is necessary for a user to do in order to mount a refill toner container is to simply insert a refill toner container in the main assembly of an image forming apparatus and simply close the front cover of the main assembly. As the front cover is closed, the refill-toner container engages with the driving portion of the main assembly, and is automatically readied for refill toner discharge. Thus, the image forming apparatus is very efficiently refilled with toner.

(3) It extremely simplifies the structure of the driving-force receiving portion of a refill toner container; it eliminates the need for a complicated structure, such as a coupler in accordance with the prior art which requires the combination of female- and male-type components, contributing to the cost reduction of the driving-force transmitting mechanism.

(4) It makes it possible to provide a driving-force transmission mechanism, which is capable of keeping the driving-force receiving portion of a refill toner container securely engaged with the driving-force transmitting portion of the main assembly of an image forming apparatus, and which yet can be reliably engaged by the simple insertion of the refill toner container into the main assembly, eliminating the engagement failure which a driving-force transmission mechanism in accordance with the prior art suffers. Therefore, it is possible to realize a driving-force transmission mechanism, a refill toner container, and a sealing member, which assure that an image forming apparatus is reliably refilled with the toner from the refill toner container.

While the invention has been described with reference to the structures disclosed herein, it is not confined to the details set forth, and this application is intended to cover such modifications or changes as may come within the purposes of the improvements or the scope of the following claims.

What is claimed is:

1. A toner supply container detachably mountable to an image forming apparatus, said toner supply container comprising:

a container body configured to accommodate toner and having an opening configured and positioned to permit the supply of the toner into the image forming apparatus; and a driving force receiving member configured and positioned to receive a driving force from a driving force applying member provided in the image forming apparatus, wherein said driving force receiving member has an elastic press-fitting member configured and positioned to elastically press-fit to an inside surface of a hollow portion of the driving force applying member to establish driving-force-transmitting engagement between said driving force receiving member and the driving force applying member.

2. A toner supply container according to claim 1, wherein said elastic press-fitting member includes a portion configured and positioned to engage by elastic restoration a part of a hole provided in the peripheral surface of the driving force applying member to establish the driving-force-transmitting engagement.

3. A toner supply container according to claim 1, wherein the driving-force-transmitting engagement is established only by the elastic force of said elastic press-fitting member.

4. A toner supply container according to any one of claims 1–3, further comprising feeding means for feeding the toner in said container body toward the opening by the driving force received by said driving force receiving member.

5. A toner supply container according to any one of claims 1–3, wherein said driving force receiving member has a sealing portion configured and positioned to prevent the toner from leaking through the opening.

6. A toner supply container according to claim 5, wherein the opening is unsealed by relative retracting of said container with respect to said sealing portion during the establishment of the driving-force-transmitting engagement.

7. A toner supply container according to claim 4, wherein said feeding means feeds the toner by rotation of said container body caused by the driving force.

8. A toner supply container according to claim 1, wherein said elastic press-fitting member is made of rubber material.

9. A toner supply container according to claim 1, wherein said elastic press-fitting member is made of resin material.

10. A toner supply container according to claim 1, wherein said elastic press-fitting member has a diameter which is larger than the diameter of the hollow portion of the driving force applying member.

11. A toner supply container according to claim 1, wherein said opening is provided at a longitudinal end of said container body.

12. A toner supply container detachably mountable to an image forming apparatus, wherein said image forming apparatus includes a hollow cylindrical member having a through hole in a periphery thereof, said toner supply container comprising:

a container body configured to accommodate toner and having an opening configured and positioned to permit the supply of the toner into the image forming apparatus;

a driving force receiving member configured and positioned to receive a driving force from the cylindrical member; and feeding means for feeding of the toner in said container body toward the opening by the driving force from said driving force receiving member, wherein said driving force receiving member includes a rubber member configured and positioned to enter a hollow portion of the cylindrical member, wherein said rubber member is elastically deformed when entering the hollow portion and said rubber member is partly elastically restored when engaging the through hole of the cylindrical member to establish a driving force transmitting engagement between said driving force receiving member and the cylindrical member.

13. A toner supply container according to claim 12, wherein the driving force transmitting engagement is established only by engagement between said rubber member and the driving force applying member.

14. A toner supply container according to claim 12 or 13, wherein said driving force receiving member has a sealing portion configured and positioned to prevent the toner from leaking through the opening.

15. A toner supply container according to claim 14, wherein the opening is unsealed by retracting the container body against said sealing portion during the establishment of the driving force transmitting engagement.

16. A toner supply container according to claim 12, wherein said rubber member has a diameter which is larger than that of the hollow portion of the driving force applying member.

17. A toner supply container according to claim 12, wherein said feeding means feeds the toner by rotation of said container body by the driving force.

18. A toner supply container according to claim 12, wherein said rubber member is partly press-fitted into an inner part of the hollow cylindrical member when the driving force transmitting engagement is established between said driving force receiving member and the hollow cylindrical member.

19. A toner supply container according to claim 12, wherein the cylindrical member has an additional through hole, and wherein said rubber member is partly elastically restored when engaging the additional hole of the cylindrical member.

* * * * *

UNITED STATES PATENT AND TRADEMARK OFFICE

CERTIFICATE OF CORRECTION

PATENT NO. : 7,088,942 B2
APPLICATION NO. : 10/278807
DATED : August 8, 2006
INVENTOR(S) : Hironori Minagawa It is certified that error appears in the above-identified patent and that said Letters Patent is hereby corrected as shown below:

TITLE PAGE AT ITEM [30]:
Foreign Application Priority Data, "2001/328268" should read --2001-328268--.

TITLE PAGE AT ITEM [57] Abstract:
Line 6, "driving-force" (1st occurrence) should read --driving force--.

COLUMN 2:
Line 14, "a" should be deleted.
Line 48, "driving force" should read --driving-force--.
Line 52, "in" should be deleted.
Line 62, "becomes" should read --become--.

COLUMN 3:
Line 53, "partially-broken away" should read --partially-broken-away--.

COLUMN 6:
Line 47, "tone-supplying" should read --toner-supplying--.

COLUMN 9:
Line 28, "driving a" should read --a driving--.
Line 60, "may" should read --may be--.

COLUMN 10:
Line 47, "relative" should read --relative to--.
Line 56, "comes" should read --come--.

COLUMN 11:
Line 20, "that" (2nd occurrence) should read --the--.

COLUMN 13:
Line 46, "front" should read --front of--.

COLUMN 14:
Line 22, "life" should read --life of--.

COLUMN 17:
Line 23, "above described" should read --above-described--.

UNITED STATES PATENT AND TRADEMARK OFFICE

CERTIFICATE OF CORRECTION

PATENT NO. : 7,088,942 B2
APPLICATION NO. : 10/278807
DATED : August 8, 2006
INVENTOR(S) : Hironori Minagawa It is certified that error appears in the above-identified patent and that said Letters Patent is hereby corrected as shown below:

COLUMN 18:
Line 15, claim 1 “driving force” should read --driving-force--.
Line 16, claim 1 “driving force” (2nd occurrence) should read --driving-force--.
Line 19, claim 1 “driving force” should read --driving-force--.
Line 22, claim 1 “driving force” should read --driving-force--.
Line 24, claim 1 “driving force” should read --driving-force--.
Line 29, claim 2 “driving force” should read --driving-force--.
Line 38, claim 2 “driving force” should read --driving-force--.
Line 40, claim 2 “driving force” should read --driving-force--.
Line 57, claim 2 “driving force” should read --driving-force--.

COLUMN 19:
Line 1, claim 12 “driving force” should read --driving-force--.
Line 6, claim 12 “driving force” should read --driving-force--.
Line 7, claim 12 “driving force” should read --driving-force--.
Line 13, claim 12 “driving force” should read --driving-force--.
Line 14, claim 12 “driving force” should read --driving-force--.
Line 17, claim 13 “driving force” should read --driving-force--.
Line 19, claim 13 “driving force applying” should read --cylindrical--.
Line 21, claim 14 “driving force” should read --driving-force--.

COLUMN 20:
Line 4, claim 15 “driving force” should read --driving-force--.
Line 7, claim 18 “driving force applying” should read --cylindrical--.
Line 15, claim 18 “driving force” should read --driving-force--.
Line 16, claim 18 “driving force” should read --driving-force--.

Signed and Sealed this

Twentieth Day of January, 2009

JON W. DUDAS
*Director of the United States Patent and Trademark Office*